US005630262A

United States Patent [19]

Tanaka

[11] Patent Number: 5,630,262

[45] Date of Patent: May 20, 1997

[54] YARN LAYING-ON-GUIDE FOR ELECTRONICALLY CONTROLLED SAMPLE WARPER

[75] Inventor: Yoshihiro Tanaka, Kiryu, Japan

[73] Assignee: Suzuki Warper Ltd., Kiryu, Japan

[21] Appl. No.: 323,790

[22] Filed: Oct. 17, 1994

[30] Foreign Application Priority Data

Nov. 9, 1993 [JP] Japan ..... 5-279886

[51] Int. Cl.[6] ..... D02H 3/00

[52] U.S. Cl. ..... 28/184; 28/190

[58] Field of Search ..... 28/184, 198, 190

[56] References Cited

U.S. PATENT DOCUMENTS

| | | | |
|---|---|---|---|
| 4,831,695 | 5/1989 | Baltzer | 28/198 |
| 4,972,562 | 11/1990 | Tanaka et al. | 28/190 |

FOREIGN PATENT DOCUMENTS

| | | | |
|---|---|---|---|
| 375480 | 6/1990 | European Pat. Off. . | |
| 434610 | 6/1991 | European Pat. Off. . | |
| 3514701 | 10/1985 | Germany . | |
| 59-50767 | 12/1984 | Japan | 28/191 |
| 63-35846 | 1/1988 | Japan . | |
| 64-10609 | 2/1989 | Japan . | |
| 64-10610 | 2/1989 | Japan . | |
| 4-57776 | 9/1992 | Japan . | |
| 7116816 | 6/1973 | Netherlands . | |

OTHER PUBLICATIONS

Brochure of Suzuki Automatic Warp Sampling Machine No Publication Date Supplied.

Operator's Manual for Automatic Warp Sampling Machine NAS Super–130 Manual, Suzuki Warper Ltd. No Publication Date Supplied.

*Primary Examiner*—Andy Falik

*Attorney, Agent, or Firm*—Nikaido, Marmelstein, Murray & Oram LLP

[57] ABSTRACT

An electronically controlled sample warper capable of warping yarns on a warper drum, with windings of the yarns neatly layered one above another in regular order, thus enabling the yarns to be readily rewound on beams on a weaving machine even when the warping length, i.e., the number of multi-windings is relatively large such as four or more windings. The sample warper includes a guide operable to ensure that the yarn for the "n"th winding is wound on the warper drum such that at the beginning of the "n"th winding, the yarn is placed ahead of an end of a winding of yarn formed on warper drum by the "n-1"th winding.

9 Claims, 35 Drawing Sheets

OPERATION/TERMINATION CIRCUIT

ELECTROMAGNETIC CLUTCH (LOWER) CONTROL CIRCUIT

PHOTOCELL B
PHOTOCELL C
PHOTOCELL A
WINDINGS COUNTER
TOTAL YARNS COUNTER
CHANGE
SELECTION
RELAY FOR YARN KIND 0
SOLENOID
YARN KIND 0
SOLENOID
RELAY FOR YARN KIND 1
SOLENOID
YARN KIND 1
SOLENOID
YARN REMOVING
SOLENOID
YARN PRESSING
SOLENOID
SHEDDING UP
SOLENOID
SHEDDING DOWN
SOLENOID
CUT SHEDDING UP/DOWN
SOLENOID

PHOTOCELL
MULTI-WINDING DISPLAY
GUIDE MEANS FEEDING
B C A B CA B CA B CA B C A ---- A B CA B C A B CA B CA
1 2 3 4 5 ---- 18 0 1 2 3
B C B C B C B C B C B C B C

ELECTROMAGNETIC CLUTCH (UPPER) (WITHOUT YARN CHANGE)
B A

ELECTROMAGNETIC CLUTCH (LOWER) (WITHOUT YARN CHANGE)
C B

ELECTROMAGNETIC CLUTCH (UPPER) (WITH YARN CHANGE)
B A

ELECTROMAGNETIC CLUTCH (LOWER) (WITH YARN CHANGE)
C B

YARN LAYING-ON-GUIDE FOR ELECTRONICALLY CONTROLLED SAMPLE WARPER

BACKGROUND OF THE INVENTION

1. Field of the Invention

This invention relates to an electronically controlled sample warper capable of preparing warping yarns in orderly layered condition without regard to the warping length, thereby enabling warping of long samples or products manufactured in small lots.

2. Description of the Related Art

Conventional electronically controlled sample warpers are exemplified by Japanese Patent Laid-open Publication No. 62-62942, which generally comprises: driving and driven shafts projecting centrally from opposite ends of a hollow shaft cantilevered at the driving-shaft side; a first small gear loosely mounted on the driving shaft and fixed to a pulley; a second small gear loosely mounted on the driven shaft and fixed to a yarn introduction lever; third and fourth small gears mounted on opposite ends of an auxiliary shaft extending through the hollow shaft and meshing the first and second small gears respectively, to cooperate with each other; drum frames mounted on the driven-shaft side of the hollow shaft and each having an outer periphery having alternately an arcuate portion and a straight portion; a pair of rollers disposed one on the arcuate portion of each of the drum frames; and a warper drum loosely mounted on the hollow shaft and having horizontal drum spokes carrying the rollers around which conveyor belts are wound. The conveyor belts are simultaneously driven to a common amount of fine movement by a drive member threadedly engaged with interior screw shafts of planetary gears meshing with a sun gear suitably driven from the exterior; as the sun gear rotates, the planetary gears rotate concurrently. The distal end of the yarn introduction lever is bent inwardly to provide a yarn introducing part disposed adjacent to the front end of the outer periphery of the warper drum. The warper also includes: a shedding means for forming a shed and a cut shed by selecting warp yarns (to be wound on the warper drum) over and under shedding bars and cut shedding bars; a total yarns counter count means for rendering an up signal, of a total counter for counting the total number of the warp yarns, to be on or off; a total yarns completion termination means for terminating the operation of the warper when the total number of the warp yarns reaches a predetermined value; a conveyor belt leftward moving means for moving the conveyor belt leftwardly; and conveyor belt rightward moving means for moving the conveyor belt rightwardly; an operation/termination means for transmitting the rotation of a main motor to the yarn introduction lever; a yarn selection means for controlling a yarn selection guide and a yarn removing unit; a yarn pressing solenoid means for rendering a solenoid of a yarn relaxation preventing (yarn pressing) unit operative and inoperative; and a windings count means for counting the number of windings of the yarns and for displaying the counted result. By selecting the kind of yarns 0-n, and setting the number of yarn, the number of repeats, the number of windings, the quantity of movement of the conveyor belt, a desired pattern of warping can be achieved automatically.

However, in this conventional warper, since an ordinary motor is used as the main motor, it is impossible to vary the rate of rotations during operating so that miscatches and mischanges as well as yarn breakage are inevitable when exchanging yarns. Additionally it is impossible to terminate relaxing and to perform jogging, thus causing only inadequate operating efficiency. For setting the density of warp yarns, the rate of moving the conveyor belt is determined by varying the gear ratio of speed change gears operatively connected to the main motor. Since the conveyor belt is moving even during idling of the remainder of the machine, regular windings of yarn on the warper drum are difficult to achieve so that the tension and the warping length would finally vary during the winding operation.

In order to overcome the above-mentioned problems, proposals have been made to employ an inverter motor or an AC servo motor in the warper (Japanese Patent Publications Nos. 64-10609 and 64-10610).

In a warper provided in accordance with another prior proposal, a plurality of warp yarns can be concurrently wound on a warper drum with omitting a yarn exchanging step to eliminate any time loss for the yarn exchange, thus reducing the warping period of time (Japanese Patent Publication No. 4-57776).

In the conventional electronically controlled sample warpers described above, in synchronism with rotation of the yarn introduction lever to wind the yarn at a fixed position around the warper drum by the necessary number of turns or windings (number of warp yarns×warping length), the conveyor belts on the warper drum are moved in the warping direction to determine the warping width. In this instance, the amount of feed or movement of the conveyor belts per each revolution of the yarn introduction lever is determined by (warping width/number of warp yarns)×(warping length/circumference of warper drum). Accordingly, if the warping length is relatively small such, for example, as equal to the circumference of the warper drum, the amount of feed of the conveyor belts per each revolution of the yarn introduction lever will be larger than the diameter (thickness) of the yarn. The yarn can, therefore, be neatly wound on the warper drum with individual turns arranged regularly, as shown in FIG. 38 of the accompanying drawings. After warping, the yarn can be smoothly rewound on a beam of a weaving machine in the form of a sheet.

However, when the warping length is relatively large such, for example, as nine times the circumference of the warper drum, the amount of feed of the conveyor belts per each revolution of the yarn introduction lever 6 is considerably smaller than the diameter (thickness) of the yarn. This means that the yarn is inevitably wound on the previously wound layer or winding of the yarn. In this instance, however, since the yarn is wound on the warper drum without restriction and hence it has an unrestrictedly wound structure such as shown in FIG. 39. Accordingly, when the windings of yarn are rewound on beams on the weaving machine in the form of sheets and in the reverse order of warping, i.e., 9 - 7 - 6 - 4 - 3 - 2 - 1, the yarn is likely to be entangled and, hence, cannot be drawn out from the warper drum A.

In other words, in the case of single winding (warping length=circumference of warper drum), the conveyor belts move a distance equal to the warp density (warp yarn pitch) per each revolution of the yarn introduction lever. On the other hand, in the case of multi-winding, such as ninth winding (warping length=warper-drum's circumference ×9), the conveyor belts move only a distance equal to [warp density (warp yarn pitch)/9] per each revolution of the yarn introduction lever. As a result, the yarn is layered at random, as shown in FIG. 39.

Thus, depending on various conditions such as fabric density, yarn diameter or thickness and warping length, smooth rewinding of the yarn cannot be achieved if four or more layers or windings of yarn are wound on the warper drum. Accordingly, there is a keen demand for an electronically controlled sample warper which is capable of warping yarns on the warper drum, with windings of yarns neatly layered in regular order: 1 - 2 - 3 - 4 - 5 - 6 - 7 - 8 - 9 (nine windings).

SUMMARY OF THE INVENTION

With the foregoing drawbacks of the prior art in view, it is an object of the present invention to provide an electronically controlled sample warper which is capable of warping yarns on a warper drum, with windings of the yarns neatly layered one above another in regular order, thereby enabling the yarns to be readily rewound on beans on a weaving machine even when the warping length, i.e, the number of multi-windings is relatively large, such as four or more windings.

According to the present invention, there is provided an electronically controlled sample warper for automatically warping yarns in a desired pattern by selecting the kinds of yarns from 0 through n and by setting the number of yarns, the number of repeats, the number of windings, and the amount of movement of a conveyor belt. The sample warper comprises certain structure together with the previously proposed structure. The driving and driven shafts project centrally from opposite ends of a hollow shaft cantilevered at the driving-shaft side. A first small gear is loosely mounted on the driving shaft and fixed to a pulley. A second small gear is loosely mounted on the driven shaft and fixed to a yarn introduction lever, the distal end of the yarn introduction lever being bent inwardly to provide a yarn introducing part disposed adjacent to the front end of the outer periphery of the warper drum. Third and fourth small gears are mounted on opposite ends of an auxiliary shaft extending through the hollow shaft and meshing with the first and second small gears, respectively, to cooperate with each other. Drum frames are mounted on the driven-shaft side of the hollow shaft and each having an outer periphery having alternately an arcuate portion and a straight portion. A pair of rollers are disposed one on the arcuate portion of each of the drum frames. A warper drum is loosely mounted on the hollow shaft and has horizontal drum spokes carrying the rollers around which conveyor belts are wound. The conveyor belts are simultaneously driven to a common amount of fine movement by a drive member threadedly engaged with interior screw shafts of planetary gears meshing with a sun gear suitably driven from the exterior. As the sun gear rotates, the planetary gears rotate concurrently. A shedding means is provided for forming a shed and a cut shed by selecting the warp yarns over and under shedding bars and cut shedding bars. A total yarns counter count means is provided for rendering an up signal, of a total counter for counting the total number of the warp yarns, to be on or off; a total yarns completion termination means is provided for terminating the operation of the warper when the total number of the warp yarns reaches a predetermined value; a conveyor belt left ward moving means is provided for moving the conveyor belt leftwardly, and a conveyor belt rightward moving means is provided for moving the conveyor belt rightwardly. An operation/termination means is provided for transmitting the rotation of a main motor to the yarn introduction lever; a yarn selection means is provided for controlling a yarn selection guide and a yarn removing unit. A yarn pressing solenoid means is provided for rendering a solenoid of a yarn relaxation preventing unit operative and inoperative. A windings count means for counting the number of windings of the yarns and for displaying the counted result. The warper of the present invention further includes guide means slidably mounted on each of the drum spokes at an end adjacent to the yarn introduction lever and slidable in the longitudinal direction of the drum spoke for guiding the yarn from the yarn introduction lever, the guide means being movable, for each revolution of the yarn introduction lever, in the warping direction by a first distance which is from twice to half the thickness of the yarn. When the number of revolutions of the yarn introduction lever reaches a preset multi-winding value, the guide means rapidly moves back a second distance which is equal to the product of the first distance and the preset multi-winding value, thus returning to its original start position, and concurrently with this quick return of the guide means, the conveyor belts are moved in the warping direction by a third distance which is equal to a longitudinal warp density, i.e., the warping width divided by the total number of yarns.

As an alternative, the yarn introduction lever may be movable in a warping direction such that for each revolution of the yarn introduction lever, the yarn introduction lever is moved in the warping direction by a first distance which is from two times to half the thickness of the yarn. In the embodiment, when the number of revolutions of the yarn introduction lever reaches a preset multi-winding value, the yarn introduction lever is quickly moved back a second distance which is equal to the product of the first distance and the multi-winding value, thus returning to its original start position, and concurrently with the quick return of the yarn introduction lever, the conveyor belts are moved in the warping direction by a third distance which is equal to the longitudinal warp density, i.e.,, the warping width divided by the total number of yarns.

As still another alternative, the conveyor belts may be movable such that for each revolution of the yarn introduction lever, the conveyor belts are moved in a direction opposite to the warping direction by a first distance which is from two times to half the thickness of the yarn. In this embodiment when the number of revolutions of the yarn introduction lever reaches a preset multi-winding value, the conveyor belts are moved in the warping direction by a second distance which is the sum of a third distance equal to the first distance multiplied by the preset multi-winding value, and a fourth distance equal to the longitudinal warp density, i.e., the warping width divided by the total number of yarns.

The prevent invention further provides a warping method carried out by the sample warper described above, in which the yarn for the "n"th winding is wound on the warper drum such that at the beginning of the "n"th winding, the yarn is placed ahead of an end of a winding of yarn formed on the warper drum by the "n-1"th winding.

The above and other objects, features and advantages of the present invention will become manifest to those versed in the art upon making reference to the following detailed description and the accompanying sheets of drawings in which a preferred structural embodiment incorporating the principles of the present invention is shown by way of illustrative example.

DETAILED DESCRIPTION OF THE INVENTION

Figure 1:
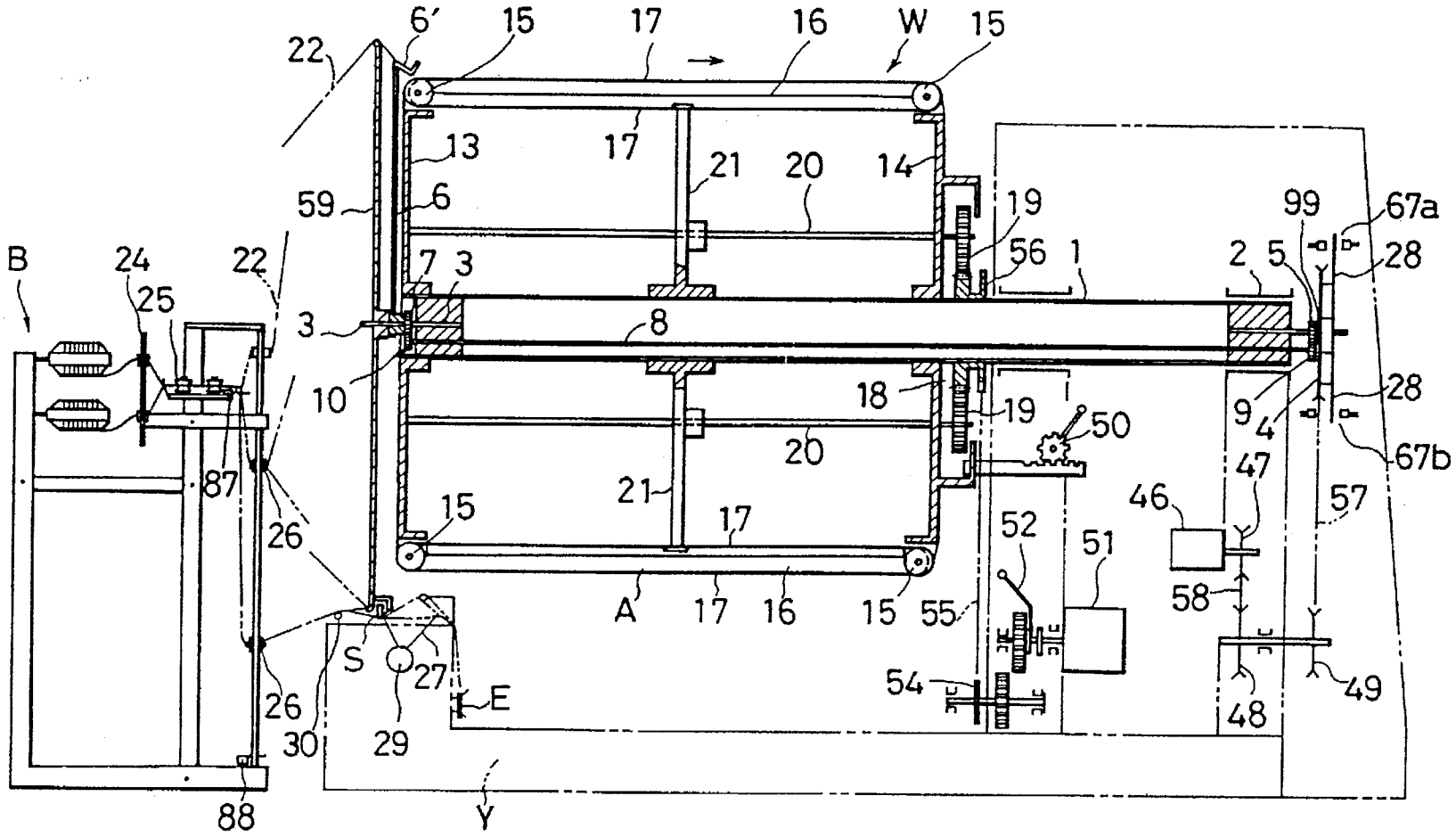
FIG. 1 is a diagrammatical side view, with parts broken away, of an electronically controlled sample warper embodying this invention, which is associated with a fixed creel.

Referring now to the drawings, wherein like reference characters designate like or corresponding parts throughout the several views, there is shown in FIGS. 1 through 4 an electrically controlled sample warper W embodying the present invention.

As shown in FIGS. 1–4, the sample warper W has a hollow shaft 1. A driving shaft 2 and a driven shaft 3 project centrally from respective opposite ends of the hollow shaft 1. On the driving shaft 2, a first small gear 5 and a pulley 99 both fixed to a pulley 4 are loosely mounted. On the driven shaft 3, a second gear 7 to which a yarn introduction lever 6 is fixed is loosely mounted. The first and second small gears 5, 7 are in meshing engagement with third and fourth small gears 9, 10, respectively, which are mounted on opposite ends of a cooperating shaft 8 extending through the hollow shaft 1. Thus, the first and second small gears 5, 7 are cooperatively connected with the third and fourth small gears 9, 10. The hollow shaft 1 is cantilevered at the driving-shaft side. A warper drum A is loosely mounted on the driven-shaft side of the hollow shaft 1.

The warper drum A is composed of a pair of drum frames 13, 14 each having an outer periphery having alternately arcuate and straight portions 11, 12. The warper drum A also includes a plurality of horizontal drum spokes 16 each supporting on its opposite ends a pair of rollers 15, 15 each resting on the arcuate portion 11 of each drum frame 13, 14. A conveyor belt 17 is wound around each pair of rollers 15, 15. All of the conveyor belts 17 are driven concurrently to a common amount of fine movement by a driving member 21 threadedly engaged with interior screw shafts 20 of planetary gears 19 which are in meshing engagement with a sun gear 18 all for co-rotation therewith, the sun gear 18 being suitably driven from the exterior of the warper drum A. The distal end of the yarn introduction lever 6 is inwardly bent to provide a yarn introduction part 6' which is disposed adjacent to the front end of the outer periphery of the warper drum A.

A fixed creel B supports a plurality of bobbins on which various yarns 22 of different colors are to be wound respectively. A guide plate 24 guides the yarns 22 drawn out from the bobbins. A tension regulator 25 adjusts the tension of the yarns 22. A dropper ring 26 is provided.

Figure 8:
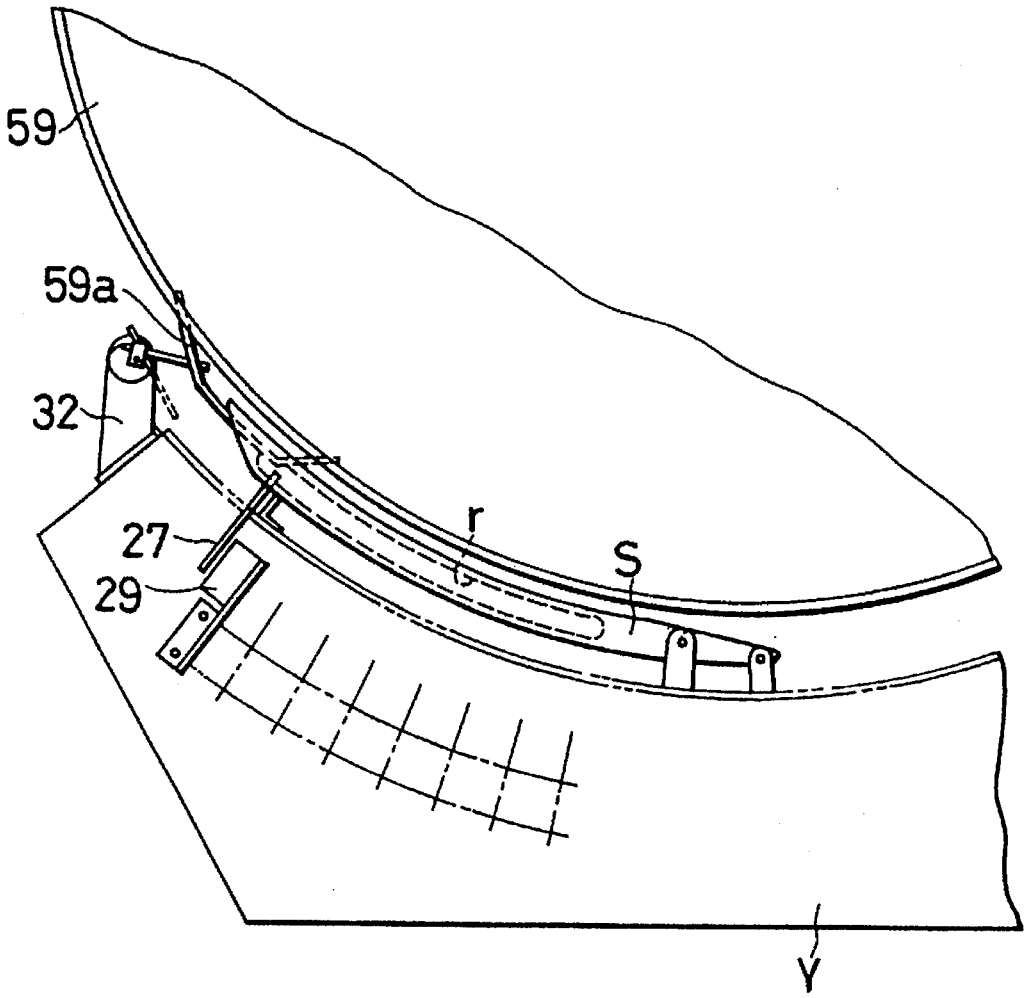
FIG. 8 is a view showing the manner in which a stop plate is attached.
Figure 9:
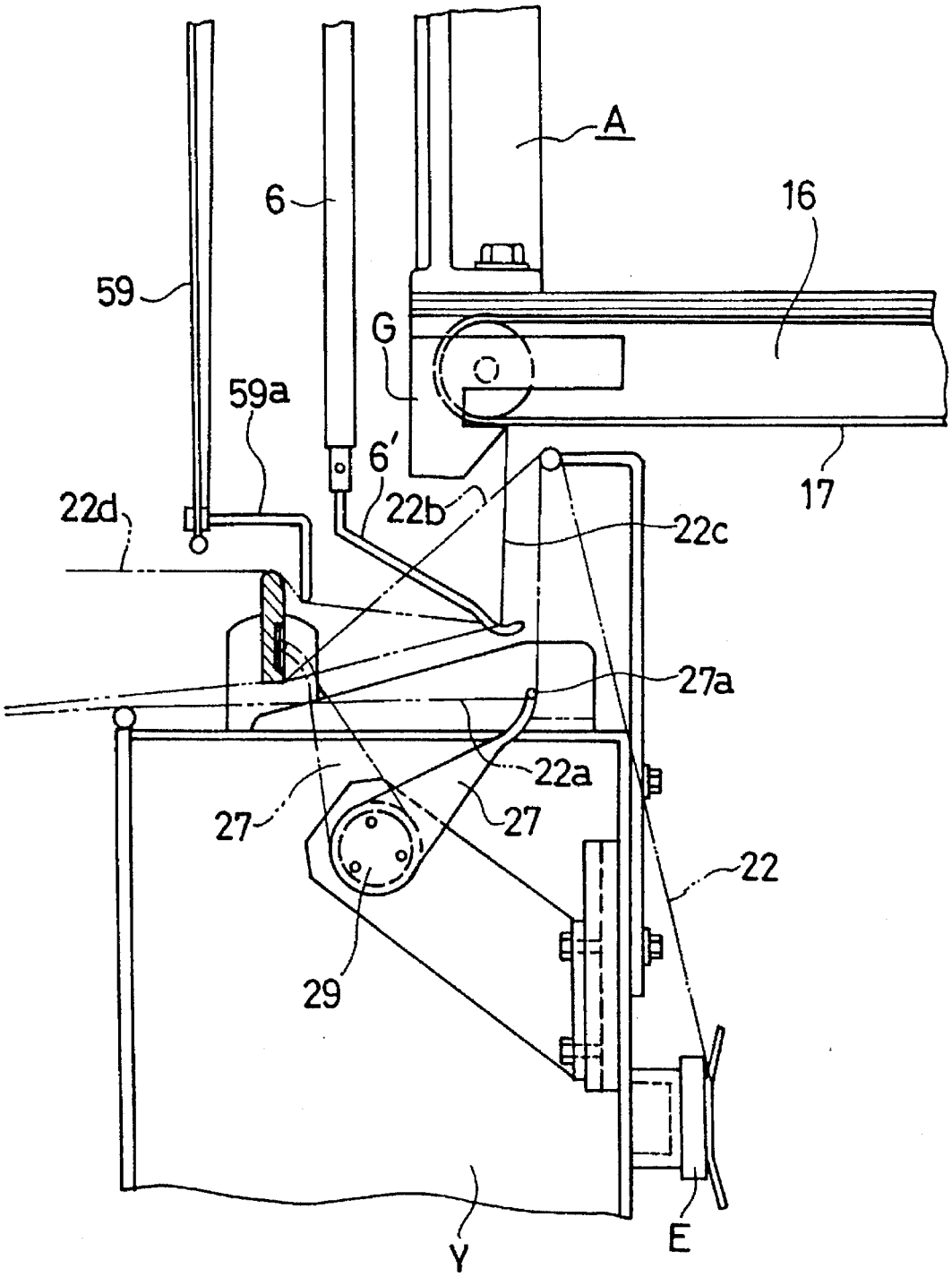
FIG. 9 is a view showing a yarn selection guide.
Figure 10:
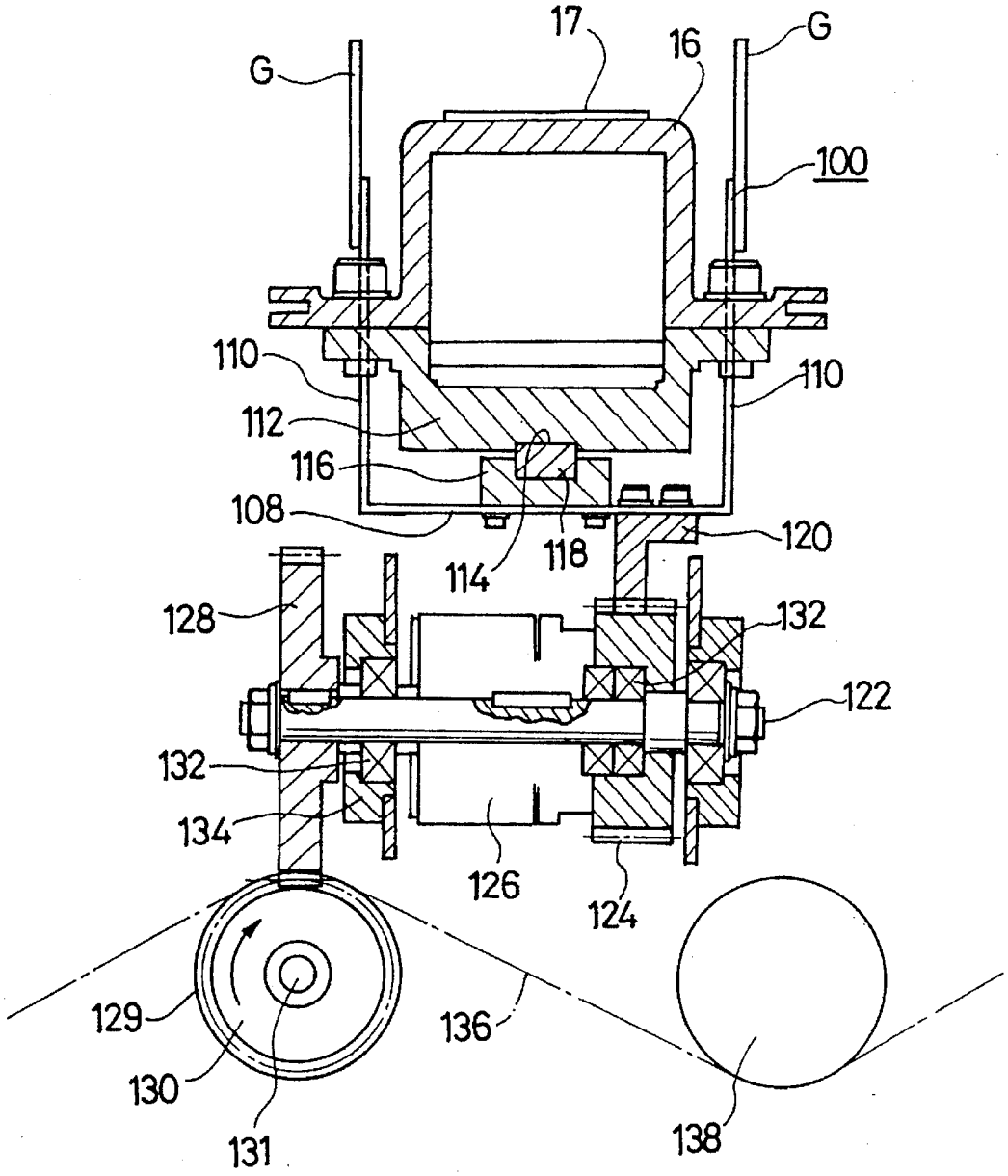
FIG. 10 is a cross-sectional view showing a guide unit moving mechanism according.
Figure 16:
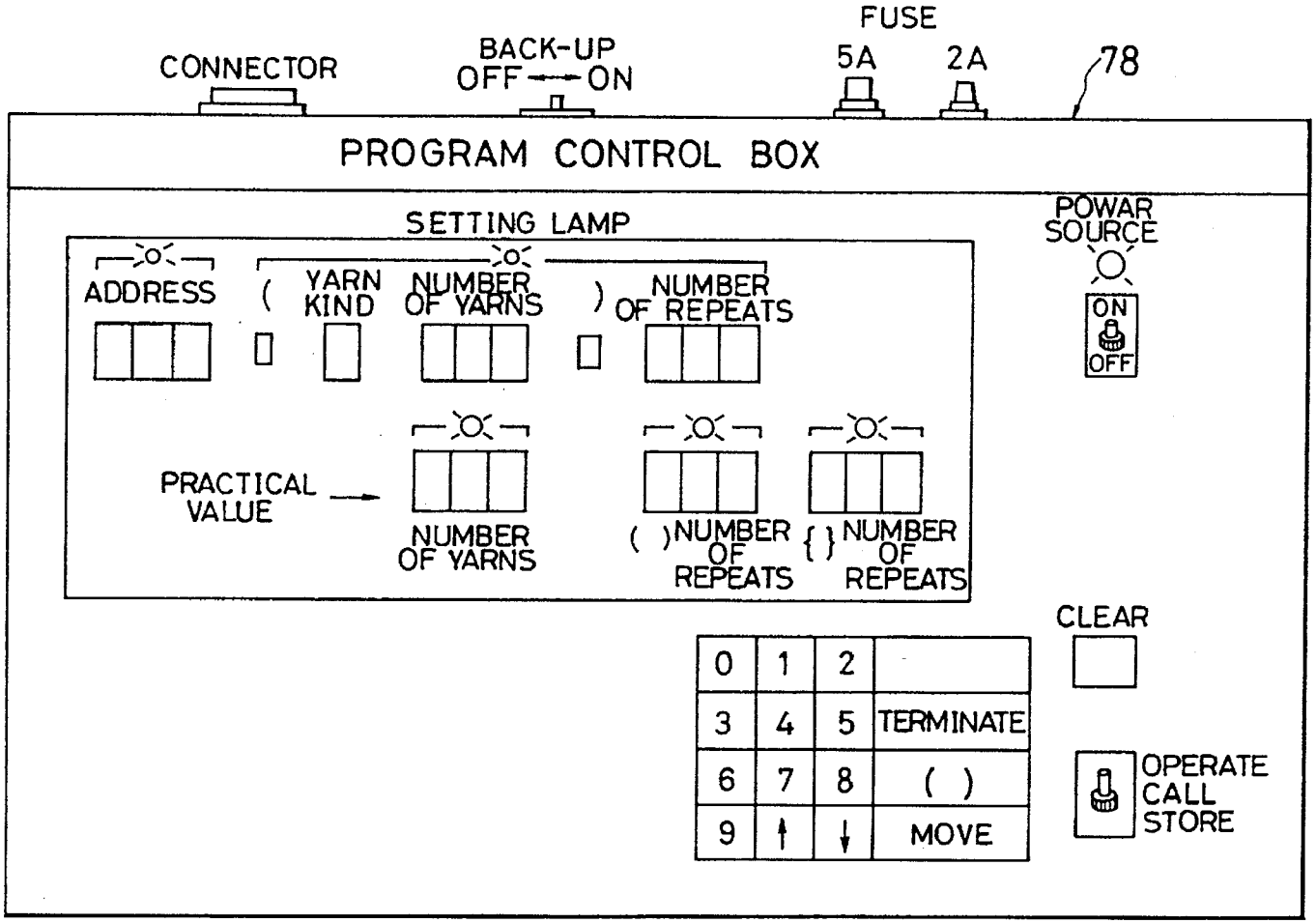
FIG. 16 is a view showing a panel surface of a program setting unit.
Figure 18:
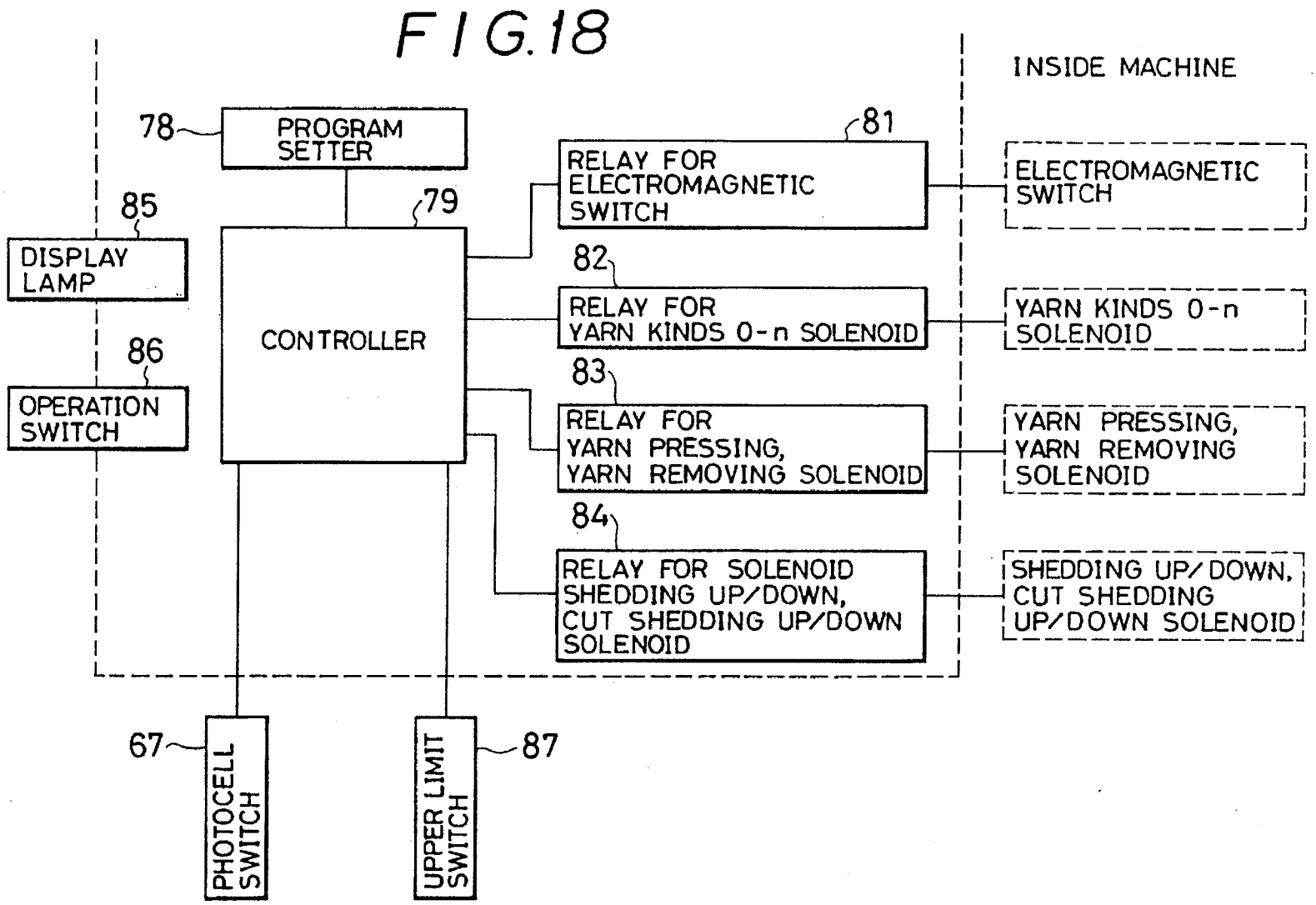
FIG. 18 is a block diagram showing the relations between various parts of the sample warper.
Figure 19:
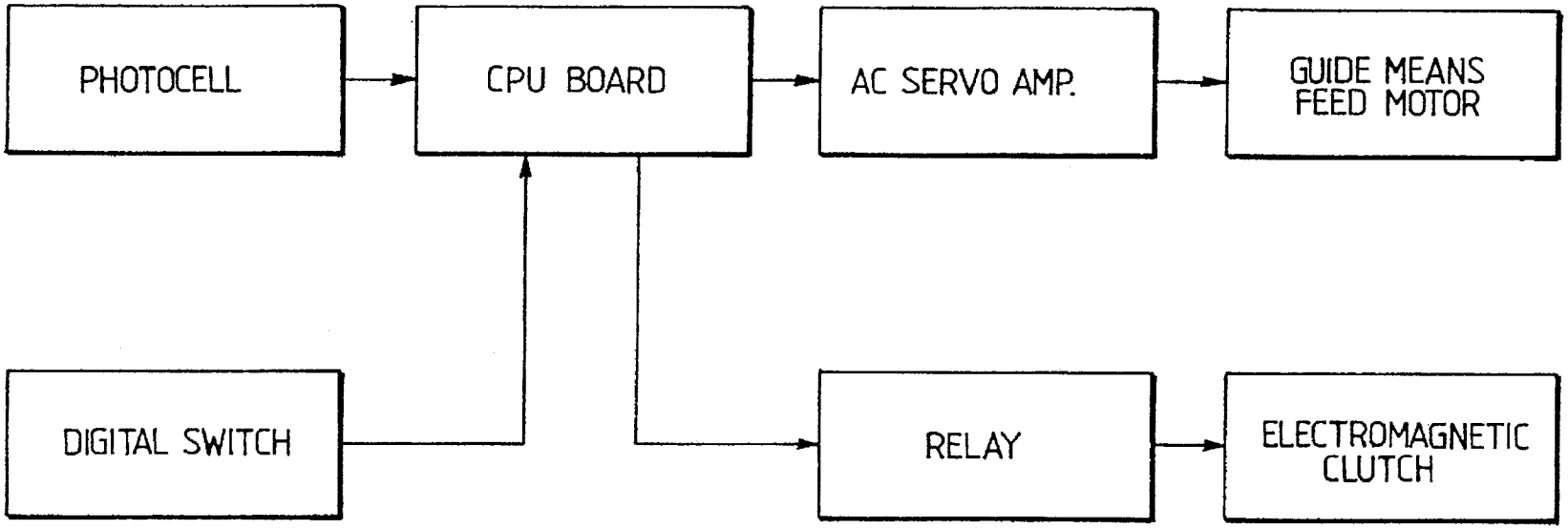
FIG. 19 is a block diagram showing the principle of a feed operation of the guide means.

Further, yarn selection guides 27 selectively guide the yarns 22 according to the instructions of a program setting unit 78 (FIGS. 16 and 18). A slitted plate 28 shown in FIGS. 1 and 3 generates pulses in response to the rotation of the pulley 4 to actuate n number of rotary solenoids 29. The yarn selection guides 27 are attached one to each rotary solenoid 29 as shown in FIGS. 8 and 9. When the individual rotary solenoid 29 is energized, the corresponding yarn selection guide 27 is angularly moved to advance to its operative position (phantom-line position in FIG. 9); when the rotary solenoid 29 is de-energized, the yarn selection guide 27 is reversely angularly moved to its original position (solid-line position in FIG. 9).

A stop plates is supported on a base Y via a support T in correspondence with the yarn selection guides 27. When the yarn selection guide 27 is angularly moved to advance to its operative position, the stop plate S receives the distal end portion 27*a* of the yarn selection guide 27 to restrict the movement of the yarn selection guide 27. A recess r is formed in the stop plate S at a portion engageable with the distal end portion 27*a* of the yarn selection guide 27. With this recess r, since the distal end portion 27*a* of the yarn selection guide 27 is engageable with the surface of the stop plate S deeper than the usual surface, a catching of the yarn during the yarn change by the yarn selection guide 27 can be performed reliably and smoothly. If this recess r did not exist, namely, if the stop plate S were merely supported, the catching of yarns could not have been performed accurately. Thus, this recess r serves to produce very significant results in this invention. The configuration of the recess r may be, for enough, such that the distal end portion 27*a* of the yarn selection guide 27 is brought in engagement with the stop plate S deeply on a rear surface thereof. Alternatively, projections or ridges may be formed on the stop plate S contiguously to such contact surface. Or only the contact surface of the stop plate S may be an elongated groove as illustrated.

A guide rod 59*a* projects from the inner surface of a lower portion of a yarn introduction cover 59 for guiding a yarn, removed during the yarn changing, so as to move to the low side of the stop plate S. A pair of guide rods 30, 31 guides the yarns 22. 32 A yarn removing unit 32 is provided for removing the yarn 22 while being wound on the warper drum A according to the instructions of the program setting unit 78.

Shedding bars 33, 34, 38 are for jointly forming a shed of the yarns 22; two of the bars 33, 38 are upper shedding bars, and the remaining bar 34 is a lower shedding bar. Cut shedding bars 35, 37 are for separating the shedding down yarns into lower-side yarns and upper-side yarns; one of the bars 35 is a cut shedding up bar, and the other bar 37 is a cut shedding down bar. A yarn stop 39 is mounted on the drum frame 13 for stopping a yarn immediately under the broken yarn being shedded. The rewinder C shown in FIG. 2 is composed of a skeleton 40, a pair of rollers 41, 42, a zigzag-shaped comb 43, a roller 44 and a beam 45 for receiving the warp to make a woven fabric on a loom.

A main motor 46 is shown in FIG. 1 and, may be an inverter motor in order to enable, during operation of the warper, the change of speed, the termination of relaxation and the jogging, thus realizing a highly increased winding speed.

A main speed change pulley 47, a V belt 58 wound on and between the main speed change pulley 47 and an auxiliary speed change pulley 48 and a counter pulley 49 which is coaxial with the auxiliary speed change pulley 48 are provided. A brake actuating pinion 50 is for reciprocatingly moving a rack to bring the rack into an out of engagement with a brake hole (not shown) in a brake drum D, thus regulating the rotational speed of the warper drum A as desired. A belt moving motor 51 (AC servo motor); a shaft lever; 52, a driven gear 53, a sprocket-wheel; 54, a chain 55, a chain wheel 56 for driving the sun gear 18 and V belts 57, 58, a yarn introduction cover 59 and a brake drum D are provided to one side of drum A and are shown in FIG. 1.

Figure 2:
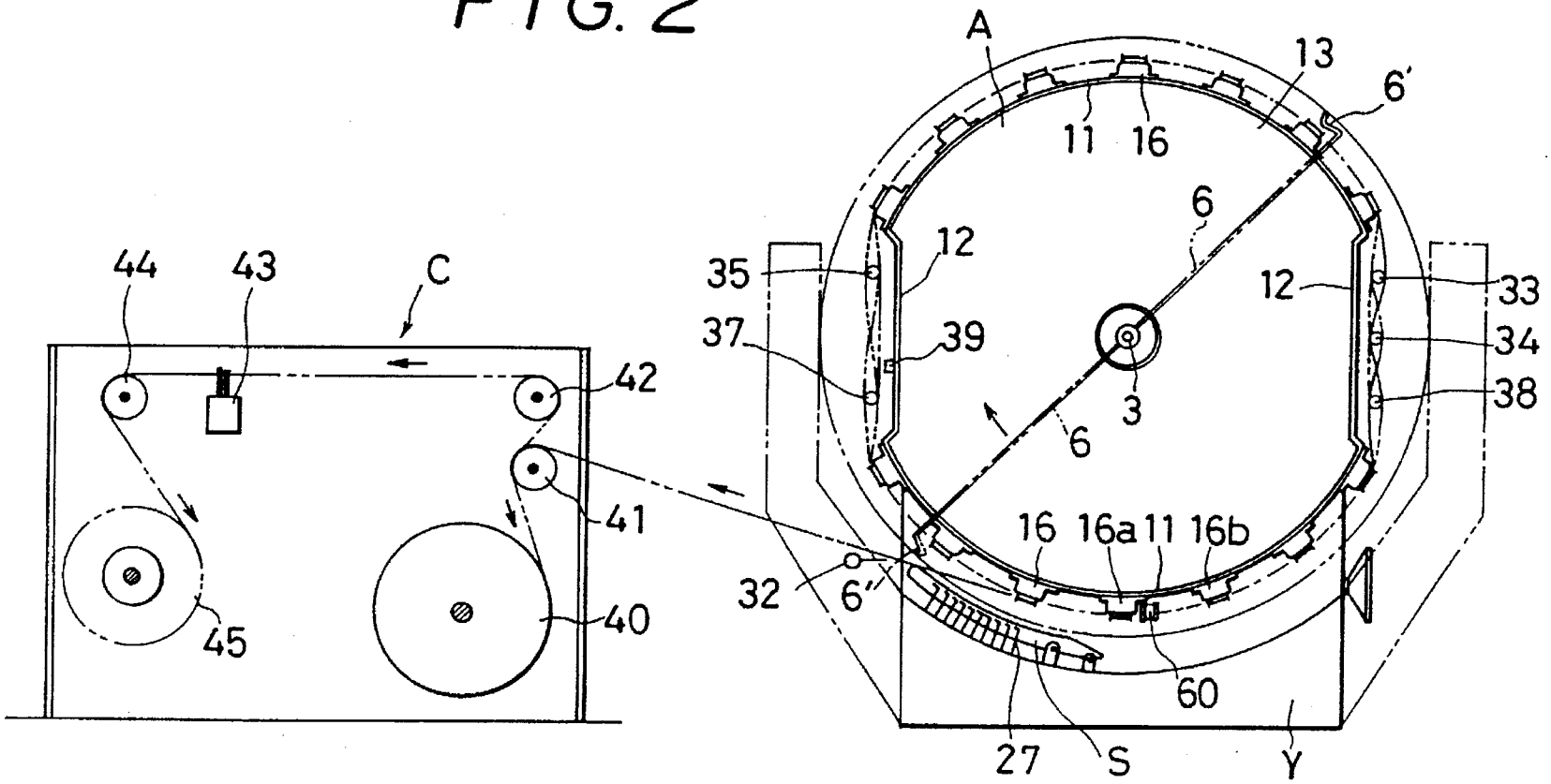
FIG. 2 is a front elevational view of the sample warper, which is associated with a rewinder.
Figure 5:
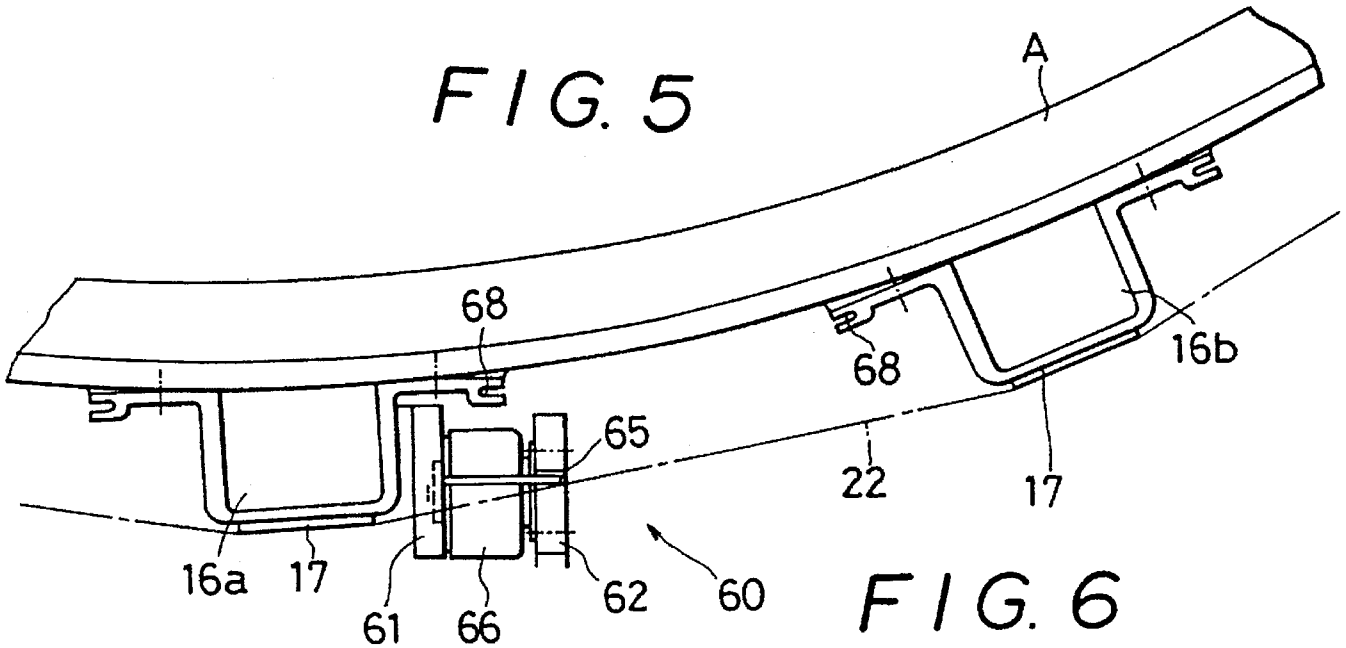
FIG. 5 is a fragmentary side view of a yarn relaxation prevention unit.
Figure 6:
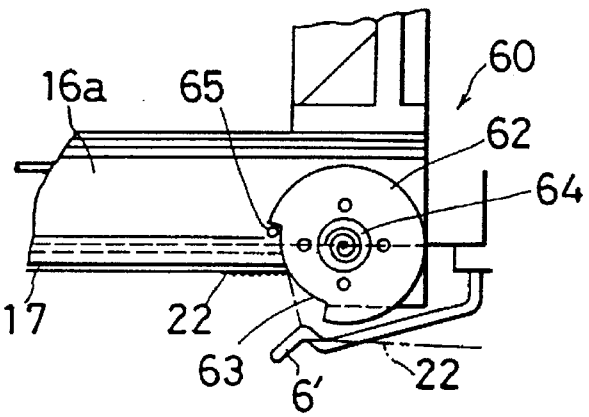
FIG. 6 is a detailed front elevational view of a portion of FIG. 5.

A yarn relaxation preventing unit 60 is attached to the side wall of one horizontal drum spoke 16*a* or 16*b* under the warper drum A coming close to the yarn selection guide 27 as shown in FIGS. 2, 5 and 6. The yarn relaxation preventing unit 60 is preferably located on the drum spoke 16*a* which is disposed at the lowermost surface of the warper drum A, but it may be located at the drum spoke 16*b* next to the drum spoke 16*a*, which performs the same functions. A bracket 61 is the means by which the yarn relaxation preventing unit 60 is attached to the side wall of the drum spoke 16*a*. A rotary disk 62 is constituting the yarn relaxation preventing unit 60. The rotary disk 62 has a yarn pressing cutaway 63 formed by cutting away about a quarter of the entire circumference of the disk 62 and is normally urged to rotate in one direction by a spiral-shaped restoring spring means 64. A stop 65 is projecting from the metal fitting 61 and is engageable with the end surface of the yarn pressing cutaway 63 to restrict the rotation of the rotary disk 62. This stop 65 serves to hold a removed yarn 22 in cooperation with the end surface of the yarn pressing cutaway 63.

A rotary solenoid 66 is attached to the bracket 61. The rotary solenoid 66 is operable, when energized, to render the rotary disk 62 in the reverse direction. Sensors 67*a*, 67*b*, 67*c* are for detecting the passing of the slit 28*a* of the slitted plate 28 (FIG. 9). The slit 28*a* is designed so as to rotate in synchronism with the yarn introduction lever 6. The sensors 67*a*, 67*b*, 67*c* detect also the rotation of the yarn introduction lever 6 by detecting the rotation of the slit 28*a*. These three sensors 67*a*, 67*b*, 67*c* are arranged at an angular space of about 120°. Of these three sensors, the sensor 67*b* is located adjacent to the lower side of the slitted plate 28 so as to detect whether the yarn introduction lever 6 has passed the yarn relaxation preventing unit 60. Now when the yarn to be removed next passes the yarn relaxation preventing unit 60 during the winding, the rotary solenoid 66 is energized by a signal from the program setting unit 78. Then when the yarn introduction lever 6, i.e., the slit 28*a* passes the sensor 67*a* spaced from the sensor 67*b* by about 240° in the direction of rotation, the rotary solenoid 66 is de-energized by a signal from the program setting unit 78. A cover attaching groove 68 is formed in the lower portion of the side wall of the drum spoke 16, in which groove 68 a cover for preventing any dust from entering the warper drum A is to be attached.

Figure 4:
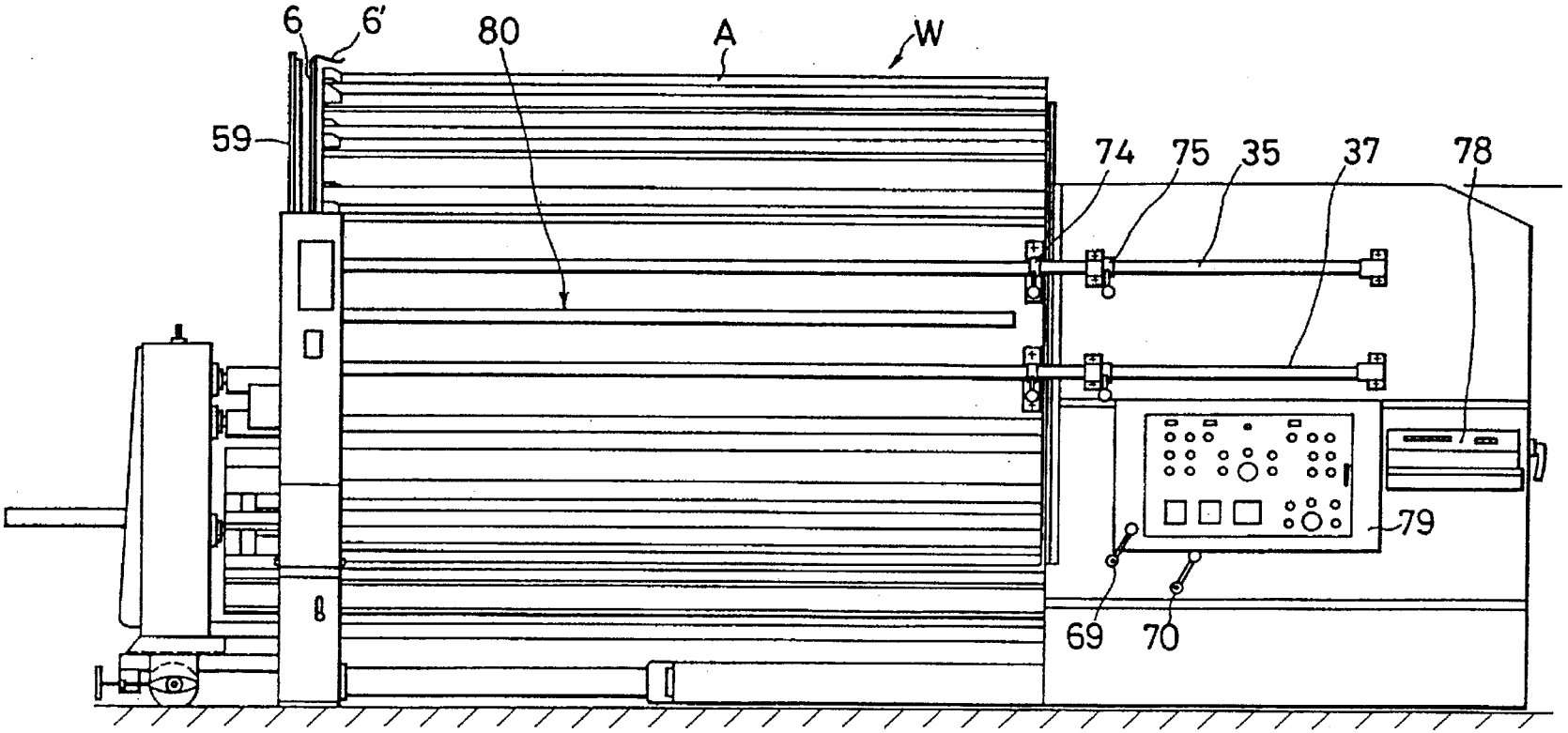
FIG. 4 is a side view of the sample warper.

In FIG. 4, a movement/stopping change-over lever 69 is for changing over the movement/stopping of the conveyor belt 17; a locking lever 70 is for locking the warper drum A; a shedding bar adjusting lever is 74; a shedding bar locking handle is 75, a controller is 79; a yarn tensioning unit 80 is located centrally on the straight part 12 of the warper drum A.

In FIG. 1, an upper limit switch 87 is mounted on the upper portion of the fixed creel B and operable each and every time the yarn 22 is wound around the warper drum A. While the yarn 22 is being wound on the warper drum A as the yarn introduction lever 6 is in rotation, this upper limit switch 87 is switched on by the yarn 22 being supplied. While the yarn introduction lever 6 is in rotation even as the yarn 22 is not wound on the warper drum A, namely, when there occurs a mischange, the upper limit switch 87 remains off, never being switched on. Utilizing the above-mentioned operation of the upper limit switch 87, confirmation is made whether the upper limit switch 87 is switched on/off each and every time the yarn 22 is wound around the warper drum A. When the upper limit switch 87 is never switched on even once as the yarn 22 makes a single turn around the warp drum A, the operation of the electronically controlled sample warper W is automatically terminated so that any inconvenience due to the mischange can be avoided.

A lower limit switch 88 is located under the dropper ring 26. When the yarn 22 is broken off, the dropper ring 26 falls to switch the lower limit switch 88 off. Upon receipt of a signal from this lower limit switch 88, the operation of the sample warper W is terminated so that any inconvenience due to the yarn breaking can be avoided.

According to an important feature of the present invention, a guide means G, as shown in FIGS. 9–15, is slidably mounted on each of the drum spokes 16 at an end adjacent to the yarn introduction part 6' and slidably in the longitudinal direction of the drum spoke 16 for guiding the yarn from the yarn introduction part 6'.

Figure 14:
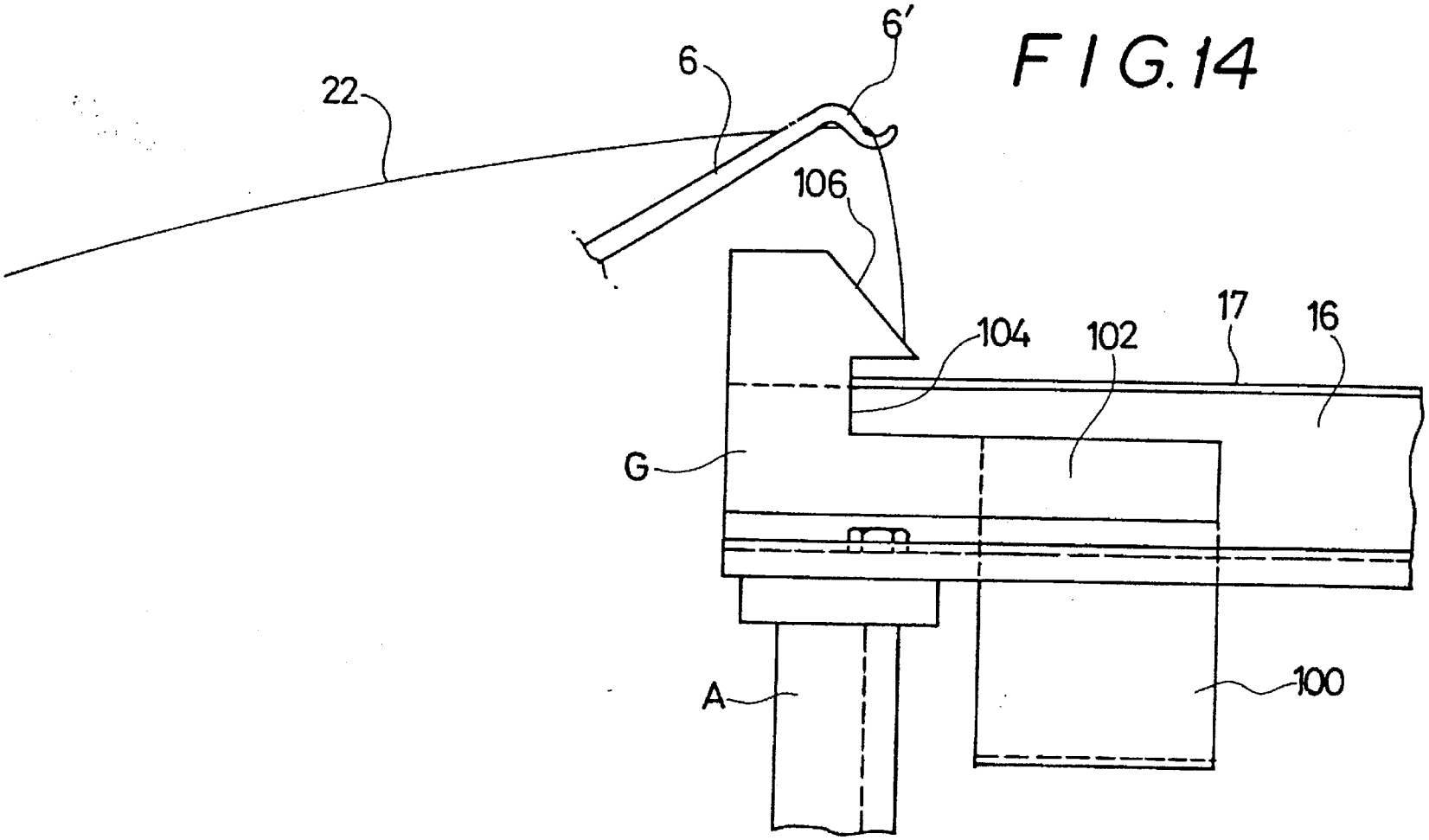
FIG. 14 is a side view of a guide means with a yarn shown in a guide condition.
Figure 15:
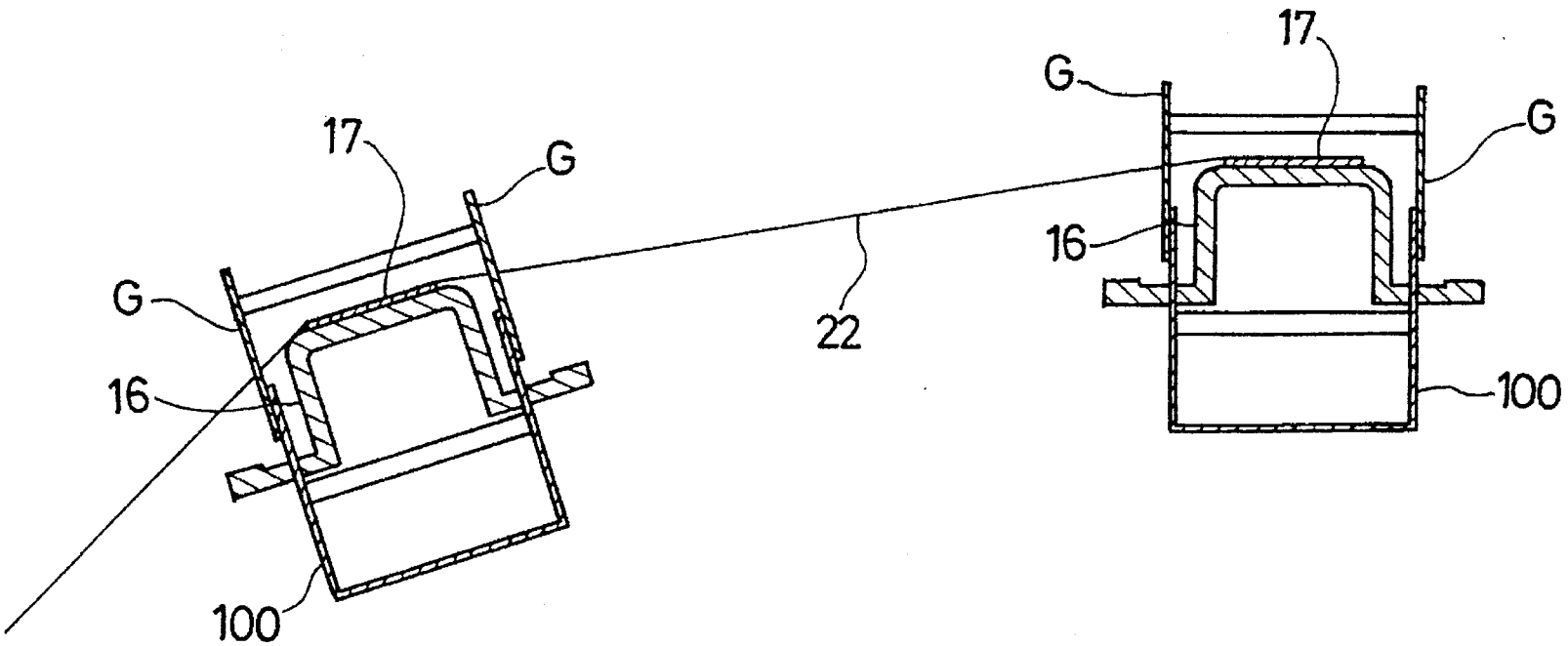
FIG. 15 is a cross-sectional view showing a manner in which a yarn is wound around belts via the guide means.

The guide means G includes a guide base 102 firmly connected to a bracket 100, a yarn guide recess 104 formed at an upper portion of one end of the guide base 102, and a yarn guide ramp surface 106 provided above the yarn guide recess 104. The yarn 22, which is guided from the yarn introduction part 6' into the guide means G, first slides down along the yarn guide ramp surface 106, then moves in the yarn guide recess 104, and finally is wound around the conveyor belt 17, as shown in FIG. 14. The bracket 100 has a channel shape including a bottom plate 108 and a pair of side plates 110 extending vertically upwardly from opposite ends of the bottom plate 108. Two of the guide means G are attached to the side plates 110 in confronting relation.

Figure 11:
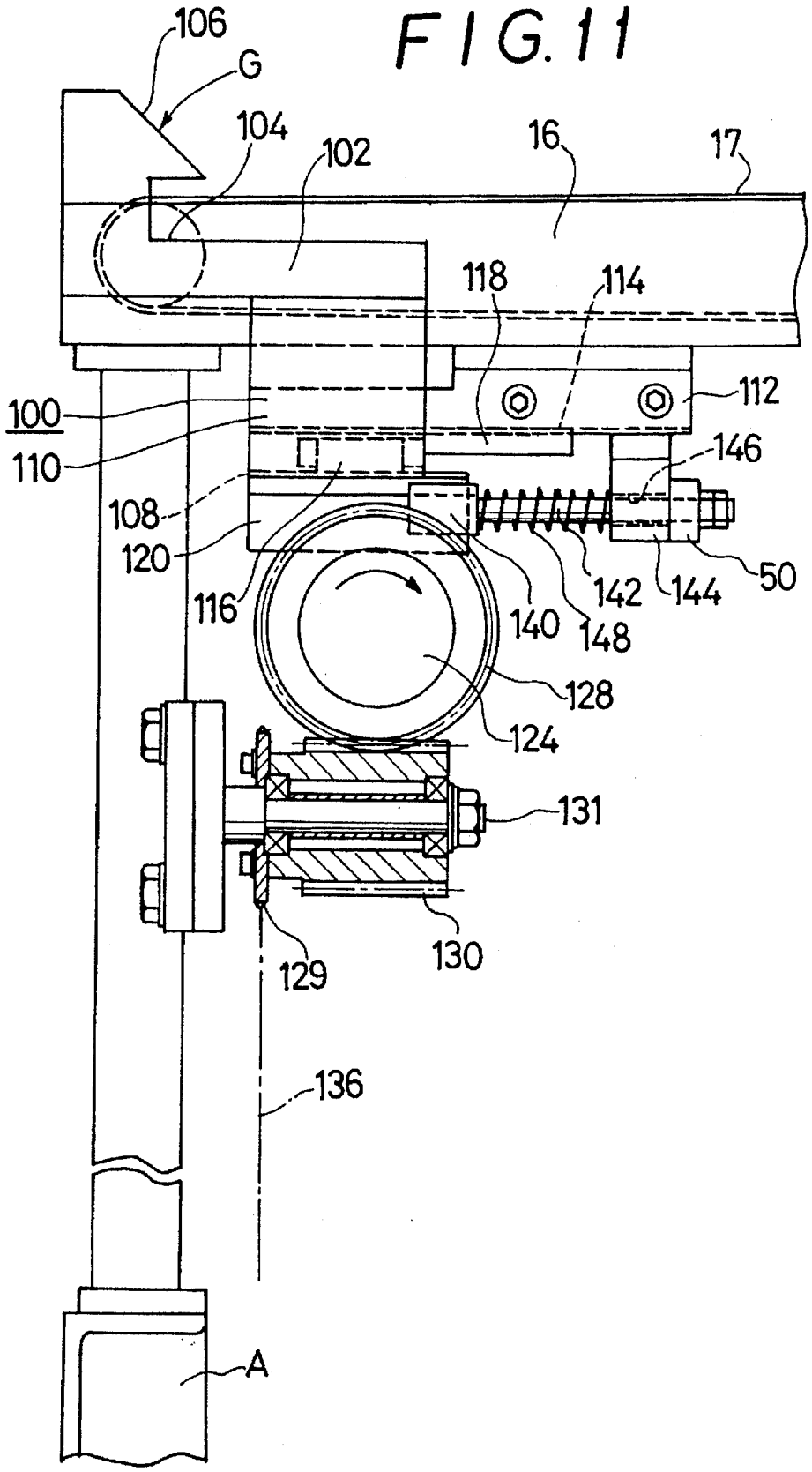
FIG. 11 is a side view, with parts in cross section, of the guide unit moving mechanism.

A slide base 112 is attached to the undersurface of the drum spoke 16. The slide base 112 has in its undersurface a longitudinal guide groove 114. A slide unit 116 is mounted on an upper surface of the bottom plate 110 of the bracket 112. The slide unit 116 has on its upper surface a guide rail 118 slidably received in the guide groove 114. To the undersurface of the bottom plate 110 of the bracket 100 is attached a rack 120 which is in mesh with a clutch gear 124 mounted on one end of a clutch shaft 122. The clutch gear 124 is engaged with and disengaged from the clutch shaft 112 by on-off operation of an electromagnetic clutch 126. When the electromagnetic clutch 126 is on, rotation of the clutch shaft 122 causes the rack 120 to move the bracket 100 in one direction along the drum spoke 16, thereby moving the guide means G in the same direction (warping direction) by a predetermined distance or pitch per each revolution of the clutch shaft 122 (this type of movement is hereinafter referred to as "pitch feed"). When the electromagnetic clutch 126 is off, rotation of the clutch shaft 122 is not transmitted to the rack 120 so that the pitch feed of the guide means G does not take place. A worm wheel 128 is attached to the opposite end of the clutch shaft 122. The worm wheel 128 is in mesh with a worm 130. A plurality of bearings 132 are provided with some in a bearing case 134. The worm 130 has a worm pin 131 to which is attached a sprocket wheel 129 in concentric relation to the worm 130 (FIG. 11). The sprocket wheel 129 is engaged with a sprocket chain 136 which is trained around an idle wheel 138 provided in correspondence with the sprocket wheel 129.

As shown in FIG. 11, a block member 140 is attached to the rack 120. The block member 140 is connected to one end of a connecting pin 142. A support member 144 is attached to the undersurface of an end of the slide base 112. The support member 144 has a through-hole 146 through which the opposite end of the connecting pin 142 slidably extends. A compression coil spring 148 is disposed around the peripheral surface of the connecting pin 142 to urge the rack 120 in a direction opposite to the direction of feed of the rack 120 caused by the worm wheel 128. A cushion member is provided at the other end of the pin 142. When the electromagnetic clutch 126 is on, rotation of the clutch shaft 122 causes the pitch feed of the guide means G against the force of the spring 148. On the other hand, when the electromagnetic clutch 126 is off, rotation of the clutch shaft 122 is not transmitted to the rack 120 so that the pitch feed of the guide means G does not take place. At the same time, the guide means G is quickly backed or returned to its original start position by the force of the spring 148.

Figure 12:
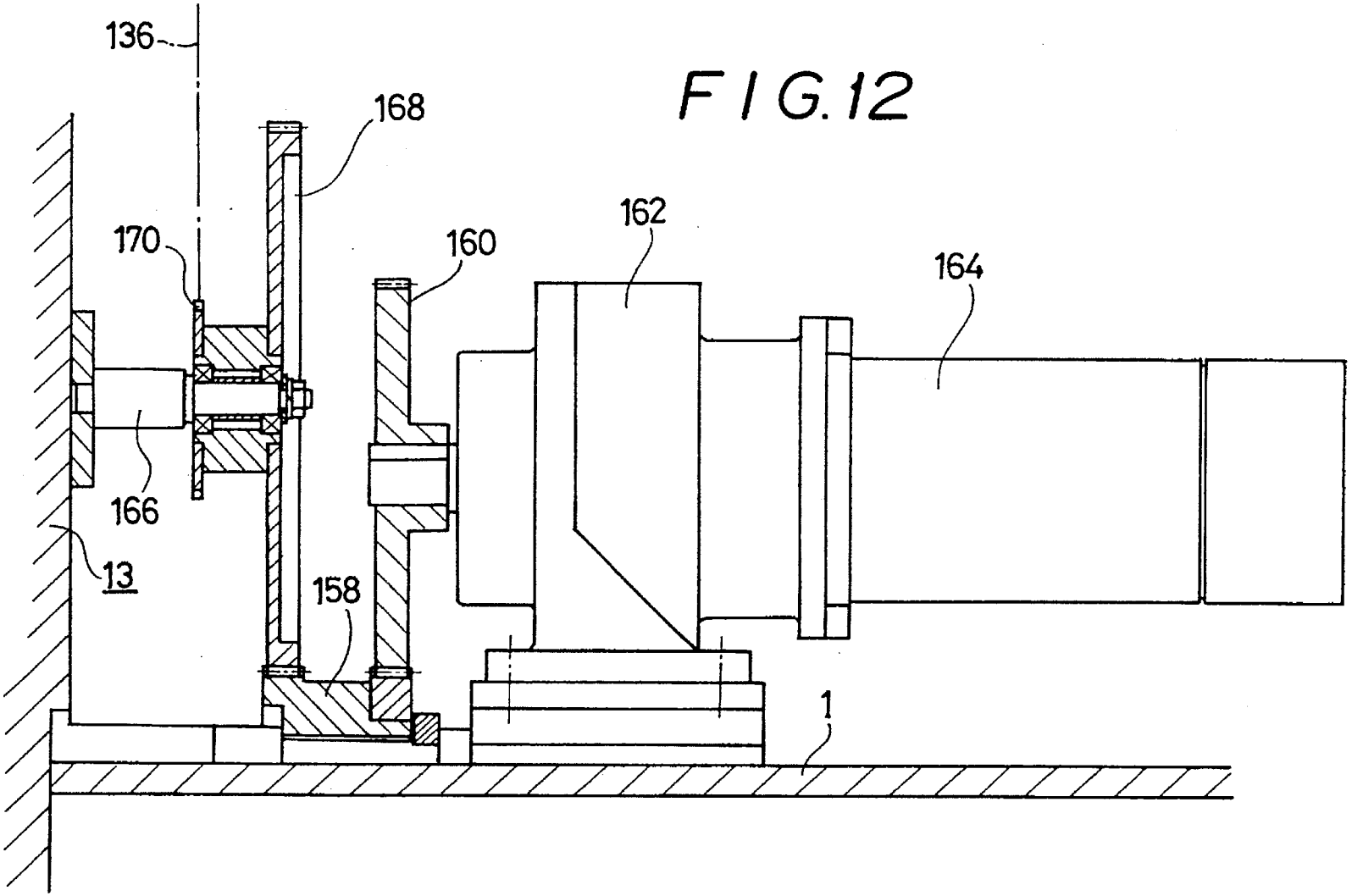
FIG. 12 is a cross-sectional view showing a meshing condition of gears in a drive system.

As shown in FIG. 12, a center gear 158 is rotatably mounted on the hollow shaft 1 of the warper drum A. A drive gear 160 is in mesh with the center gear 158 and driven by a servo motor 164 via a speed reducer 162. A transmission shaft 166 is attached to the drum frame 13. The transmission shaft 166 supports on its front end a transmission gear 168 meshing with the center gear 158. A sprocket wheel 170 is mounted on a central portion of the transmission shaft 166. The sprocket wheel 170 is engaged with the sprocket chain 136.

Figure 13:
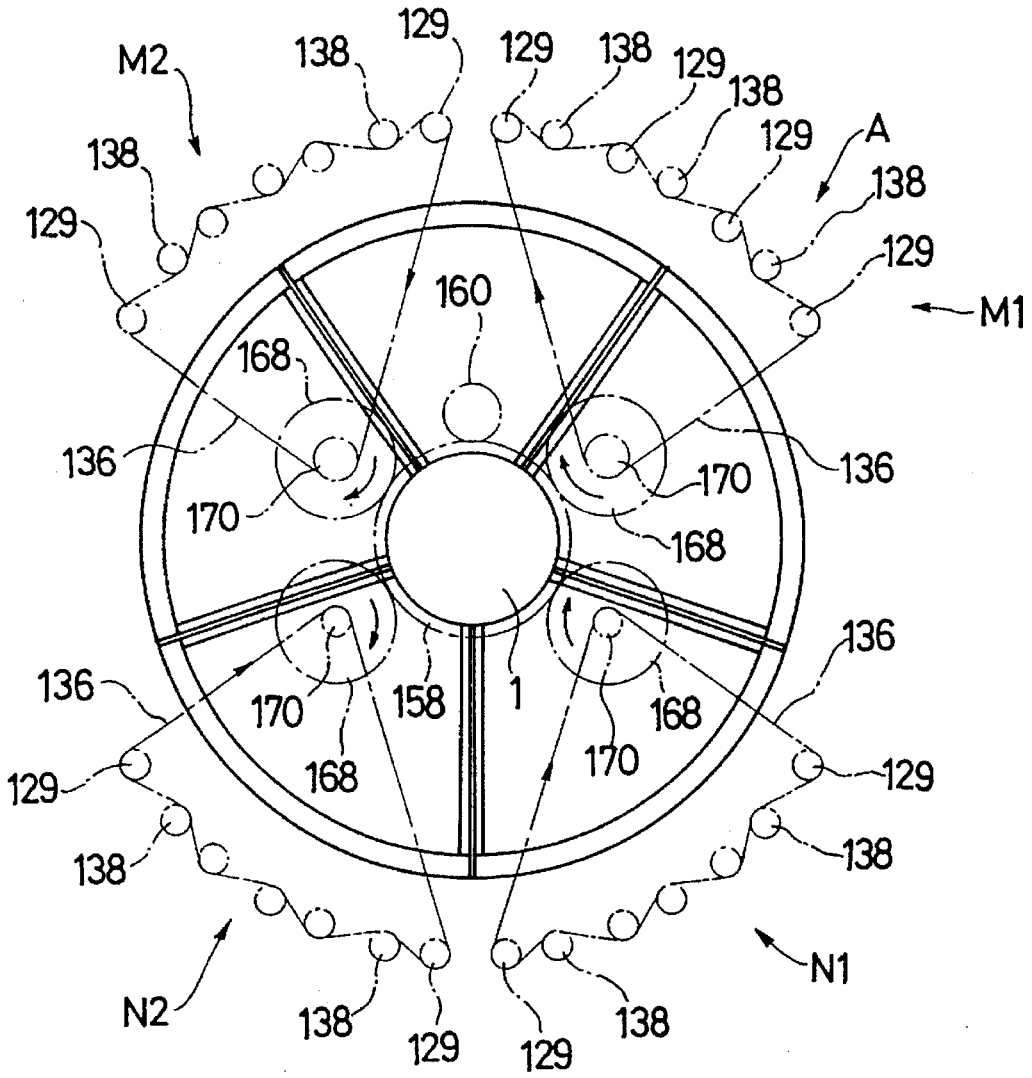
FIG. 13 is a side view, with parts omitted for clarity, of a winding condition of a sprocket chain in the drive system.

As shown in FIG. 13, the sprocket wheels 129, the idler gear wheels 138, and the sprocket chains 136 trained around the sprocket wheels 170 are separated into four sets or groups. Specifically, four sprocket wheels 129, three idle wheels 138 and one sprocket wheel 170 are trained by one sprocket chain 136 to form a single drive system, so that there are four drive systems which are grouped into two upper drive systems M1 and M2, and two lower drive system N1, N2.

A group of electromagnetic clutches 126, composed of respective electromagnetic clutches 126 on the corresponding clutch shafts 120 to which the sprocket wheels 129 are attached, respectively, are electrically divided into two circuits; one including an upper electromagnetic clutch group constituting the upper two drive system M1, M2, and the other including a lower electromagnetic clutch group constituting the lower two drive systems N1, N2.

FIG. 16 shows the control part of the electronically controlled sample warper W. The program setting unit 78 is capable of selecting the 0-n number of kinds or types of yarns, setting the number of yarns, setting the number of repeats, and setting the amount of feed or movement of the guide means G, by ten figure key switches of 0–9, a ↑ switch, a↓ switch, a move switch, a (11) switch, a termination switch, a CLR (clear) switch and a paper feed switch. The thus set program can be printed out by a small-sized printer, and the contents of the program, i.e., address, the presence of (11), the kinds of yarn, the number of yarns, and number of repeats can be displayed by LEDs. The control part includes various switches for storing, operation and reading, so that it is possible to display the preset conditions when in operation, and it is possible to correct the program when reading.

The program setting unit 78 is electronically connected to the controller 79 via the yarn kind signal, the yarn change signal and the count up signal. As these signals are successively received, the preset program is repeated in order. The contents of the program utilize the four fundamental rules of arithmetic formulae as is well known in the art. For example, the program in which ten windings of types 1 yarn, five windings of type 2 kind yarn and seven windings of types 3 yarn are repeated three times, and thereafter six windings of type 4 yarn and two windings of type 5 yarn are added, can be expressed by a formula of $(1\times10+2\times5+3\times7)^3+4\times6+5\times2$. For another example, a much more complex program expressed by the formula of $\{[(1\times2+2\times3)^3+1\times4]^5+2\times6\}^7+3\times5$ can be prepared. A program once set is protected by a back-up battery unless the program is changed.

Figure 17:
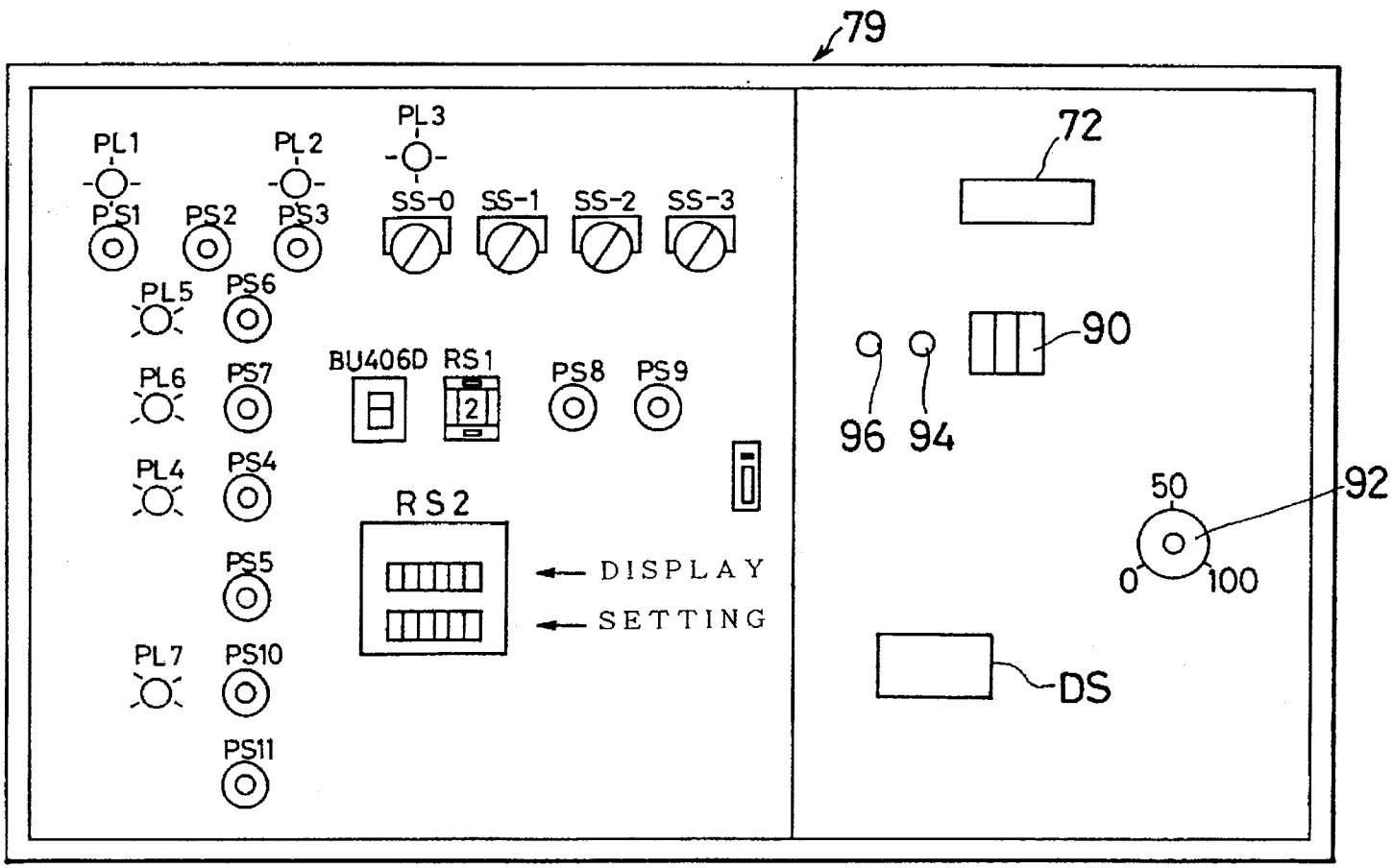
FIG. 17 is a view showing a panel surface of a controller.

The controller 79 physically shown in FIG. 17 and dynamically shown in FIG. 8 controls the warper W. Specifically, according to the program preset by the program setting unit 78, the controller 79 controls a relay 81 for electromagnetic switch, a relay 82 for types 0-n kind yarn solenoid, a relay 83 for yarn pressing and yarn removing solenoids, a relay 84 for shedding up, shedding down, cut shedding up and cut shedding down solenoids, a display lamp 85, etc., all of which are electrically connected to the controller 79.

The relay 81 for electromagnetic switch controls the switching on/off of the winding motor. The relay 82 for types 0-n yarn solenoid controls the types 0-n yarn solenoid when the relay for yarn selection relay is on. The relay 83 for yarn pressing and yarn removing solenoids controls the yarn pressing and yarn removing solenoids. The relays 84 for shedding up, shedding down, cut shedding up and cut shedding down control the shedding up, shedding down, cut shedding up and cut shedding down solenoids, respectively.

The display lamps 85 are lamps for displaying the operation states of the warper W. Specifically, the display lamps 85 display the power source on, the rightward movement of the conveyor belt, the leftward movement of the conveyor belt, the shedding up, the shedding down, the energization of the main motor, double winding, the total number of yarns, and the multi-winding. Operation switches 86 are switches for controlling the warper W. Specifically, the operation switches controls the power source, the automatic termination of the warper motor, the multi-winding setting, the conveyor belt movement termination, the rightward movement of the conveyor belt, the leftward movement of the conveyor belt, the shedding up, the shedding down, the energization of the main motor, the de-energization of the main motor, the double winding reset switch, the total yarns counter, etc.

Figure 7:
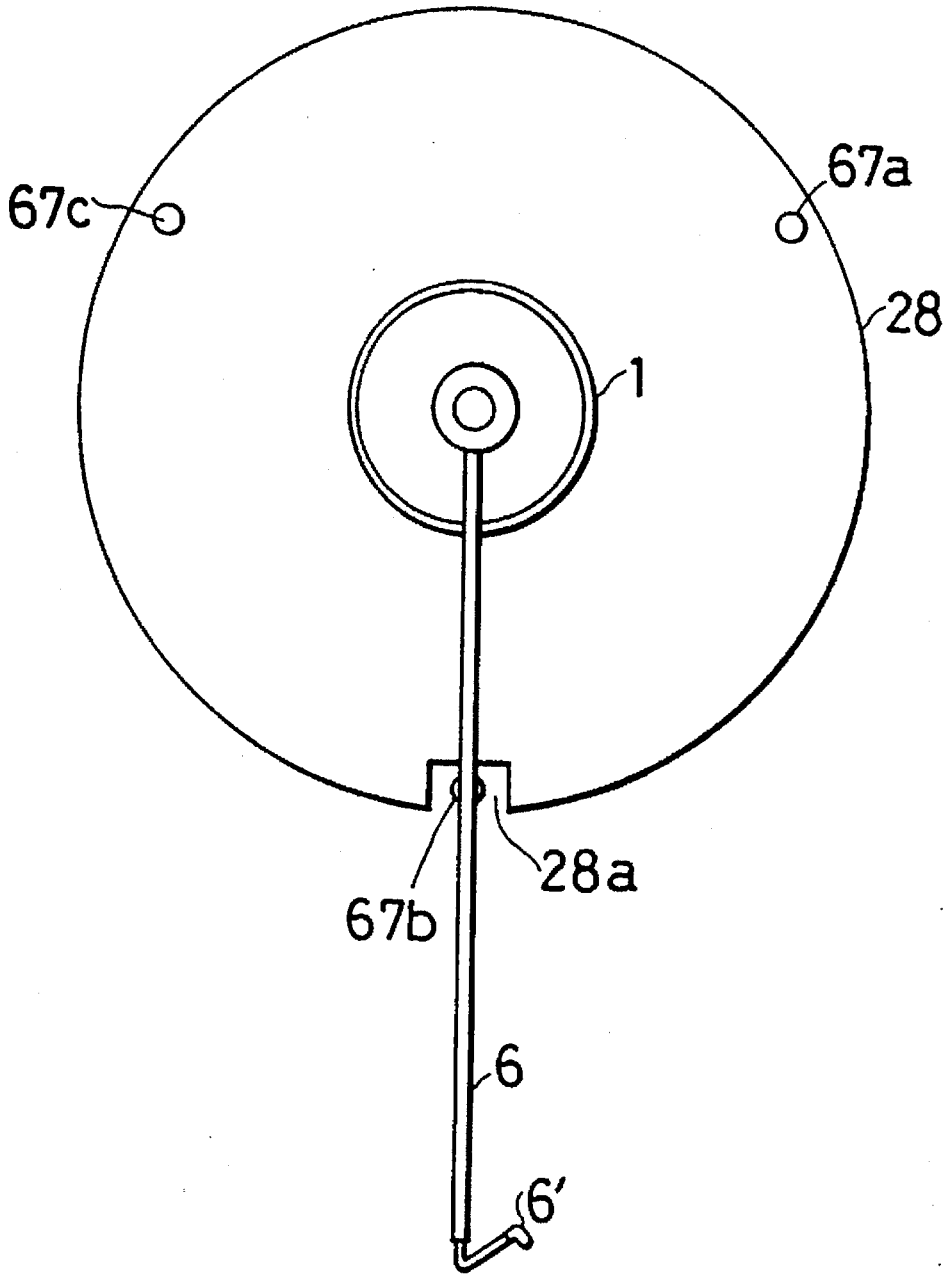
FIG. 7 is a view showing the arrangement of a yarn introduction lever and a slitted plate.

Photocell switches 67 are composed of three photocell switches *67a, 67b, 67c* supported on the warper W (as shown in FIG. 7). These three photocell switches *67a, 67b, 67c* are arranged one at each of generally trisectional circumferential positions for timing between the yarn selection, the yarn pressing, the yarn removing, the shedding, the cut shedding, the counting up, etc.

A switch 87 for double-winding termination detects whether the yarns on the creel stand B for fixed supply yarn are wound two at a time and transmits a signal to the controller 79. The warper W is also equipped with a yarn breakage detection switch for terminating the main motor 46, various solenoid to be controlled by the above-mentioned relays, an electromagnetic switch, a mischange display, etc.

FIG. 16 shows the physical board surface of the program setting unit 78, and FIG. 17 shows the physical board surface of the controller 79. In FIG. 16, PL1 designates a belt fast feed left ward movement display lamp; PL2, a belt fast feed rightward movement display lamp; PL3, a power source display lamp; PL4, a main motor ON display lamp; PL5, a shedding up display lamp; PL6, a shedding down display lamp; PL7, a double winding termination display lamp; SS-0, a power source switch; SS-1, a midnight power source switch; SS-2, a main motor forward/reverse rotation switch; SS-3, a mischange circuit switch; PS1, a belt fast feed left ward movement switch; PS2, a belt fast feed termination switch; PS3, a belt fast feed rightward movement switch; PS4, a main motor ON switch; PS5, a main motor OFF switch; PS6, a shedding up switch; PS7, a shedding down switch; PS8, a multi-winding manual count switch; PS9, a multi-winding count reset switch; PS10, a double winding reset switch; PS11, a main motor reverse rotation fine movement switch; RS1, a multi-winding setting switch; BU406D, a number-of-winding setting unit; RS2, a warp yarns setting unit; and DS, a digital switch for setting the amount of feed of the guide means G.

Further, the board of the controller 79 also has a warp yarn speed meter; 72, a warping length setting unit, 90, and a maximum-number-of-rotations setting dial 92 of the main motor 46. The maximum number of rotations of the main motor 46 may be set also by setter built in the inverter. A belt feed rightward fine movement switch 94 and a belt feed leftward fine movement switch 96 are provided. These two switches 94, 96 are correction switches in which one-pitch feeding of the conveyor belt can be possible by the mechanical switch when the main motor is off.

In addition, though there is no illustration in the drawings, the warper also includes an inverter for inputting an operation termination signal, a jogging signal, a multistep speed change signal and a forward/reverse rotation signal via the controller (sequence board) 79 to control the rotation of the main motor 46, and an AC servo motor control part for inputting a conveyor belt rightward movement signal, a conveyor belt leftward movement signal, an operation termination signal, the warping width, the number of warp yarns, the number of windings, a photocell signal, etc. via the controller (sequence board) 79, the multi-winding setting unit RS1 and the warping length setting unit 90 to control the angle of rotation of the conveyor belt motor 51.

The operation of the above-described electronically controlled sample warper W will now be described.

Firstly, the yarns 22 are different in number depending on the pattern or design of a sample. Bobbins on which various yarns of n number of colors, for example, are wound respectively are supported on the fixed creel B. A desired number of yarns 22 are drawn out from the bobbins and are threaded through the guide plate 24, the tension regulator 25, the dropper ring 26, and the selection guide 27 and are pressed against the base Y by a yarn fastener E with permanent magnet. Thus the yarns 22 have been set.

Then, concurrently with the operation of the warper W according to a prepared arrangement preset by the program setting unit 78, the yarn introduction part 6' takes a circular motion over and around the warper drum A to thereby wind the yarns 22 over the conveyor belts 17. At that time the conveyor belts 17 also are moved in the direction of an arrow (rightwardly in FIG. 1) by the action of the interior screw shafts 20. As the pulley 4 is rotated, pulses are produced by the slitted plate 28 to render the n number of rotary solenoids 29 operative. When the selection guide 27 attached to the rotary solenoid 29 are advanced to its operative position, the yarn 22 having been tensioned between a pair of guide rods 30, 31 is caught by the yarn introduction part 6' and is thereby wound around the conveyor belts 17. According to the next instructions of the program setting unit 78, the yarns 22 being wound is removed by the action of the yarn removing unit 32, and then another yarn is wound on the conveyor belts 17 according to the next instructions of the program setting unit 78.

The movements of the yarn 22 during the yarn changing will now be described with reference to FIG. 9. The yarn *22a* caught by the selection guide 27 initially located in the original position assumes its position **22*b* as the selection guide 27 is pivotally moved to advance to its operative position. From this position, the yarn 22*b* is wound around the warper drum A by the yarn introduction part 6'. 22*c* designates the posture in which the yarn 22 is wound one turn, and 22*d* designates the posture in which the yarn 22 is wound two or more turns. When the yarn 22*d* wound on the warper drum A is removed therefrom by the yarn removing unit 32, the yarn assumes again its posture 22*b*. Because the distal end 27*a* of the yarn selection guide 27 is located in the recess r of the stop plate S as the yarn selection guide 27 is angularly moved to advance to its operative position to catch the removed yarn 22*b*, the yarn selection guide 27 can catch the removed yarn 22*b*** smoothly and reliably, thus avoiding accidents such as a double winding.

At that time, as the yarn 22 to be removed and thus the yarn introduction lever 6 has passed the yarn relaxation preventing unit 60, the sensor **67*b* makes an immediate detection so that the rotary solenoid 66 is energized by a signal from the program setting unit 78 and the controller 79. Upon its energization, the rotary solenoid 66 causes the rotary disk 62 to rotate in a direction against the bias of the spring member 64 so that the yarn located in the yarn pressing cutaway 63 is pressed by the end surface of the yarn pressing cutaway 63 and the stop 65. This pressing continues for only a short period of time, namely, until the yarn introduction lever 6 reaches the position of the sensor 67*a*, whereupon the yarn relaxation preventing unit 60** stands by for the next possible removal of the yarn.

Upon termination of the yarn pressing by the rotary disk 62, the yarn selection guide 27 is returned to its original position with keeping this removed yarn taut due to the weight of the dropper ring 26, and then the yarn selection guide 27 waits for the next instructions of the program setting unit 78 to make windings of the yarn in order in a predetermined arrangement.

During the winding, the shedding bars 33, 34, 38 make the shedding operation, and the cut shedding bars 35, 37 divide the shedded yarns into a lower group of the yarns and an upper group of the yarns. In the wound-up yarns, the shedded yarns are cut by the action of the cut shedding bars 35, 37, and the lower group of yarns are stopped by the yarn stop 39 mounted on the drum frame 13, while the upper group of the yarns are led to a fabric round the skeleton 40 of a rewinding unit C and then are wound therearound via the roller 41. Thereafter the yarns may be taken up, from the roller 42, onto the beam 49 for woven fabric via the roller 42, the zigzag-shaped comb 43 and the roller 44 without any difficulty.

Figure 20:
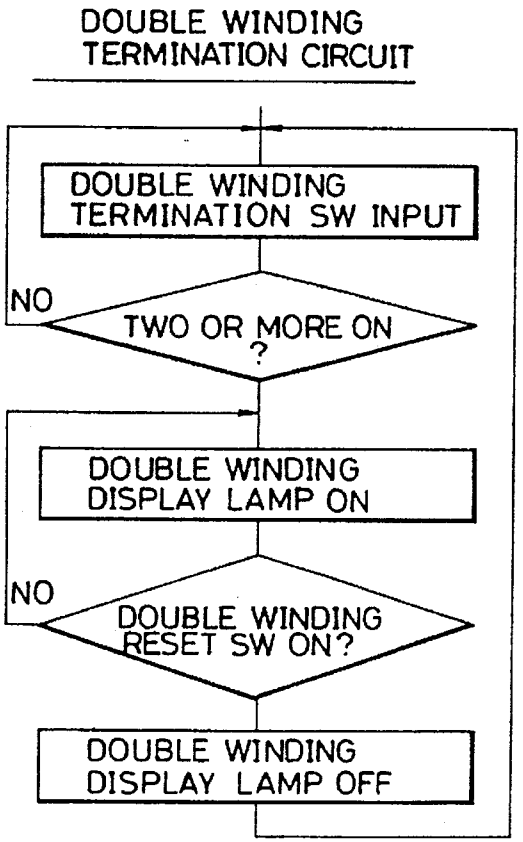
FIG. 20 is a flowchart showing the operation of a double winding termination circuit.

The operation of the electronically controlled sample warper of this invention will now be described with reference to FIGS. 20 through 34. The program is adapted for performing a parallel processing in which successive routines of "a" through "o" (FIGS. 20 through 34) are repeated at intervals of from about 0.5 to 1 millisecond.

a: Double Winding Termination Circuit (FIG. 20)

Figure 3:
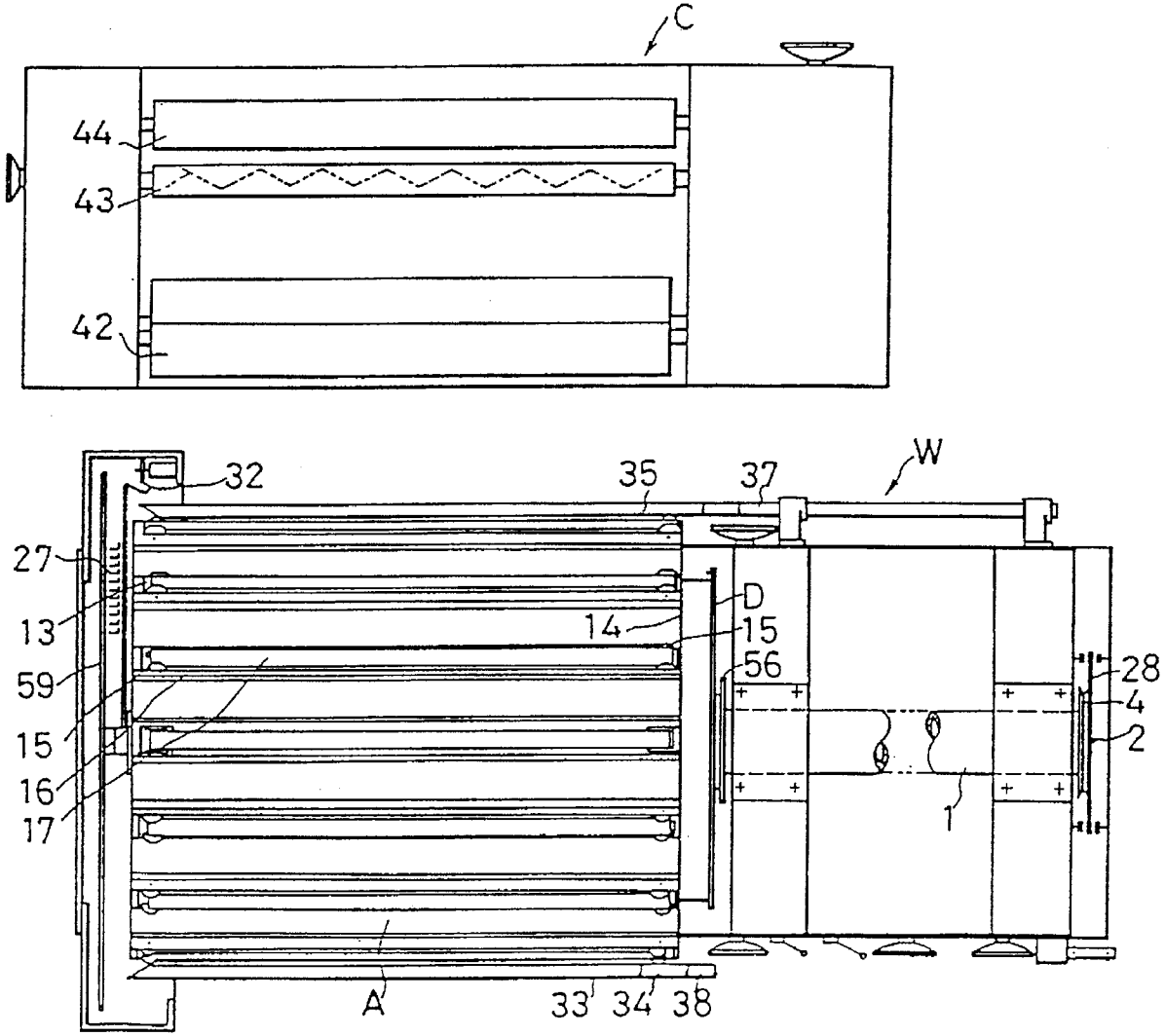
FIG. 3 is a plan view showing the arrangement of the sample warper, the fixed creel and the rewinder.
Figure 3:
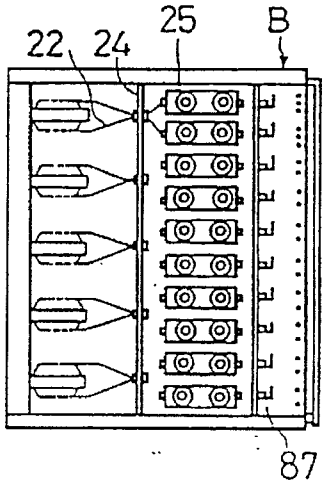
Figure 21A:
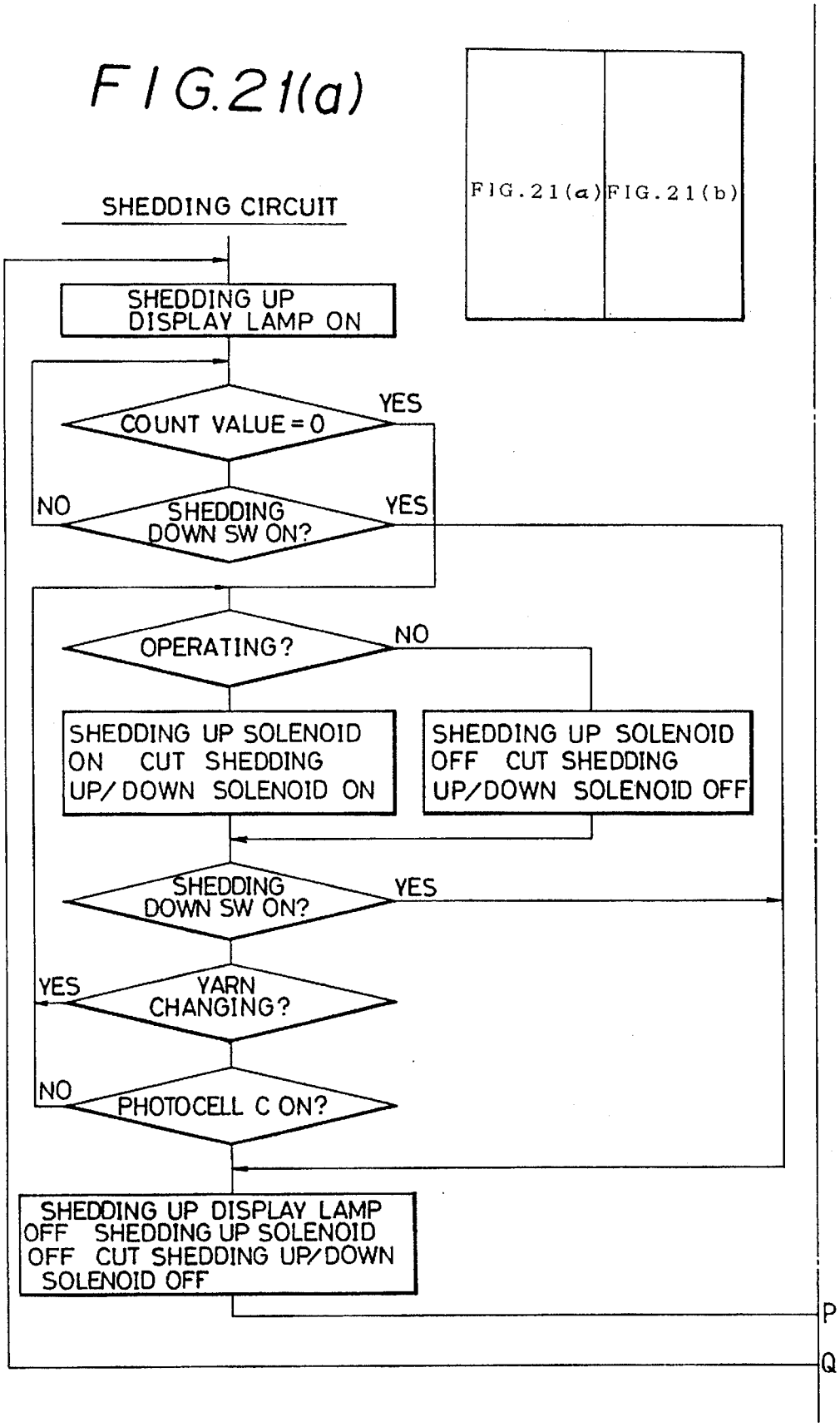
FIG. 21(*a*) and 21(*b*) are a flowchart showing the operation of a shedding circuit.
Figure 21B:
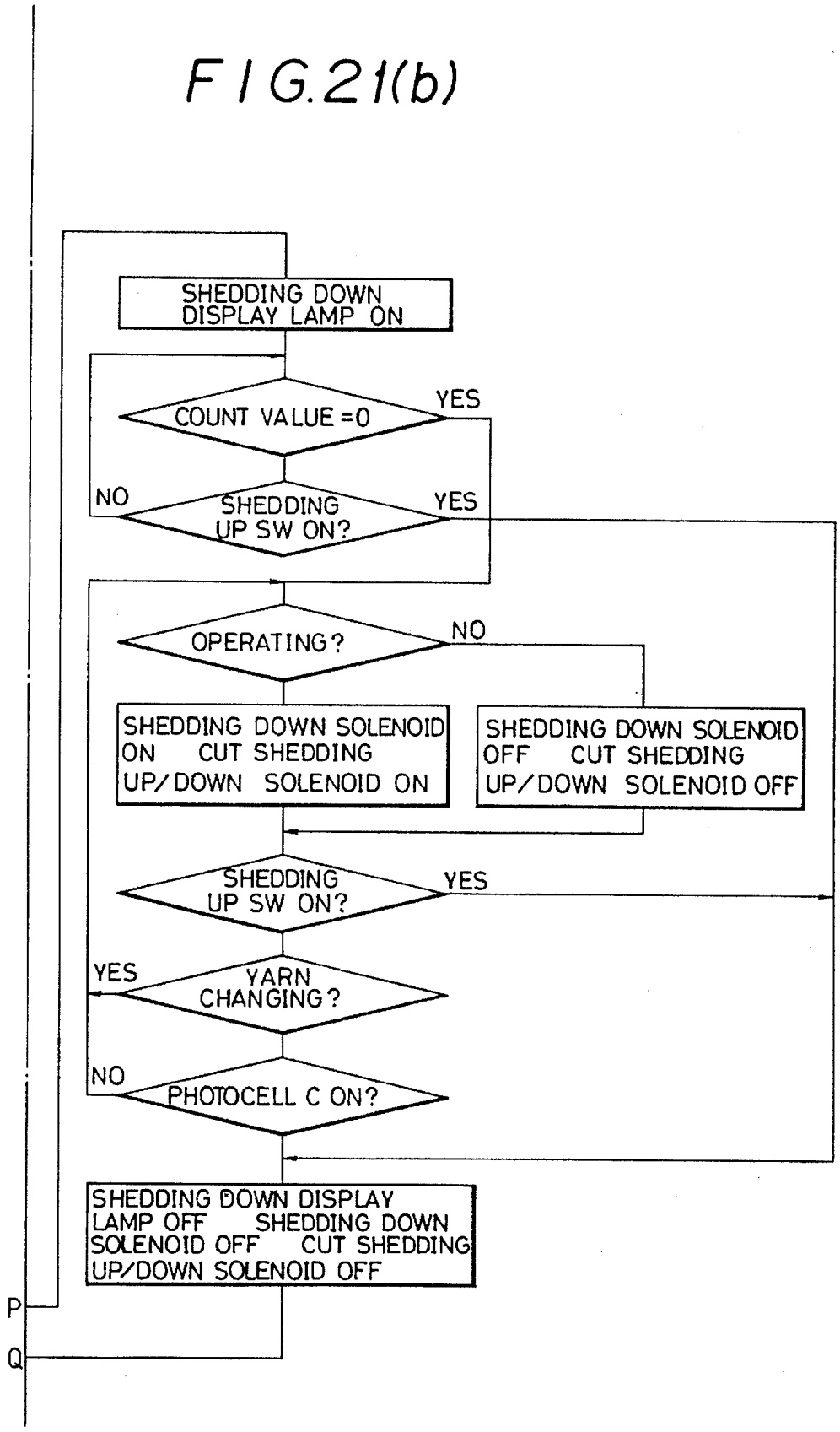
Figure 24:
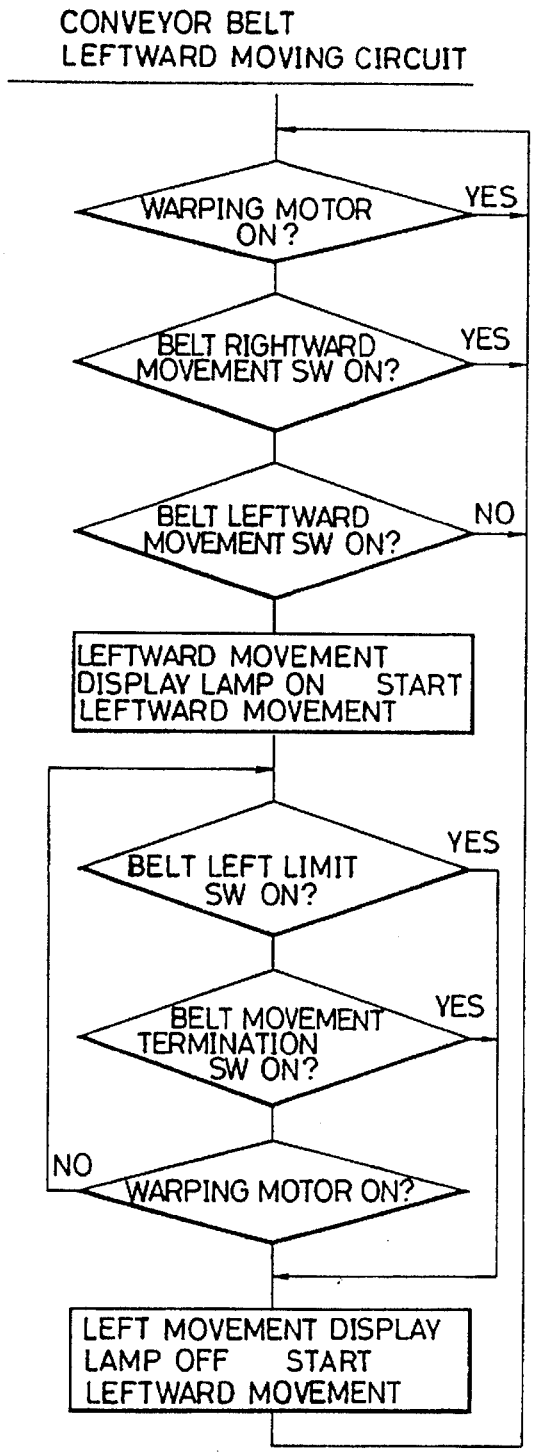
FIG. 24 is a flowchart showing the operatino of a conveyor belt leftward moving circuit.

The double winding detecting sensors, namely, the upper limit switches 87 are supported on a creel stand for the yarn supply (FIG. 3). There are n number of sensors one for each yarn supplied. The individual sensor 87 issues an output when the yarn 22 is wound on the warper drum A by the yarn introduction part 6'. If the two or more yarns are concurrently caught by the yarn introduction part 6' due to a misfeed during the yarn selecting, the output of the sensor 87 turns the double winding display lamp on. This output signal is combined circuitwise with the warper termination switch SW to terminate the warper W. The releasing is made by a double winding reset switch.

b: Shedding Circuit (FIG. 21)

The shedding bar assembly is composed of four kinds of shedding bars, i.e., shedding up bars 33, 38, a shedding down bar 34, a cut shedding up bar 35, and a cut shedding down bar 37. The solenoids are connected one to each of the shedding bars 33–38. By the action of the individual solenoids, the yarns to be wound on the warper drum A are brought selectively upwardly and downwardly of the individual shedding bar to make a shedding and a cut shedding. The shedding at the start can be selected by the shedding up switch and the shedding down switch.

In the shedding method while the yarn is not being exchanged, if the warper is in operation and also if the count value "0" (winding turns display is "0") is confirmed, the three kinds of solenoids, namely, the shedding up solenoid, the cut shedding up solenoid and the cut shedding down solenoid are switched on, and are switched off by the photocell C (**67*c*). Concurrently, the shedding down display lamp is switched on. As the count is "0" (multi-winding display is "0"), the three kinds of solenoids, namely, the shedding down solenoid, the cut shedding up solenoid and the cut shedding down solenoid are switched on, and are switched off by the photocell C (67*c***). At the same time, the shedding up display lamp is turned on. Upon the next count "0" (multi-winding display is "0"), the foregoing procedures are repeated.

Figure 22:
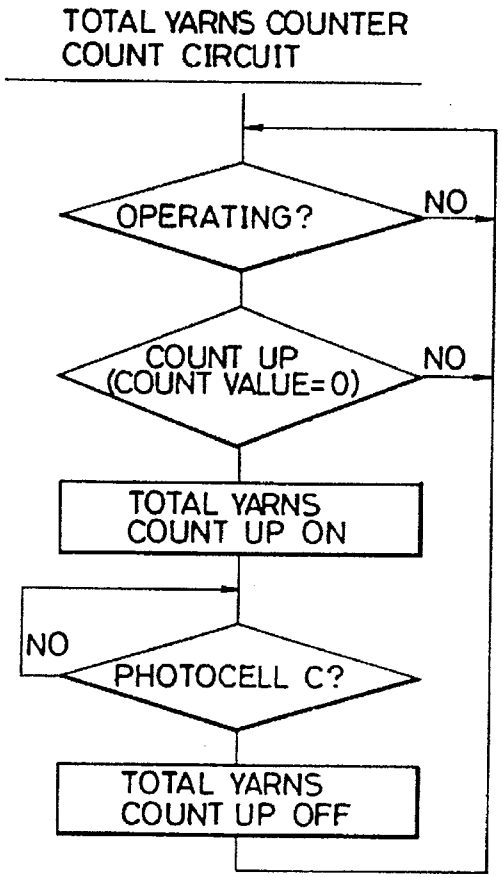
FIG. 22 is a flowchart showing the operation of a total yarns counter count circuit.

Thus in the shedding method, while the yarn is not being exchanged, the individual solenoid moves one over rotation (during the yarn changing) than the operation time of each solenoid during the shedding while the yarn is not being exchanged.

c: Total Yarns Counter Count Circuit (FIG. 22)

Figure 23:
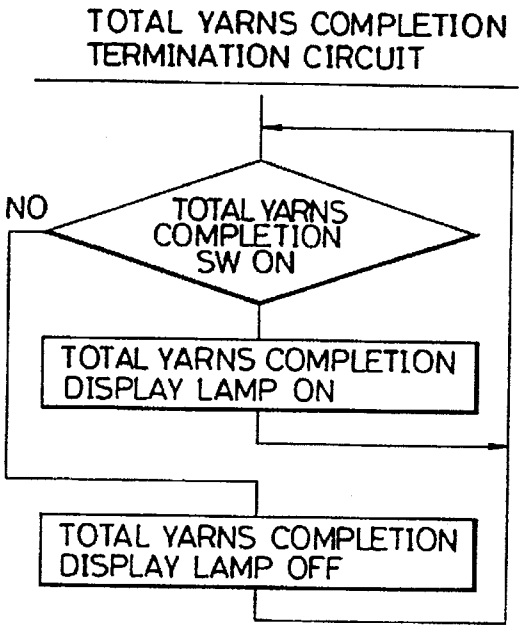
FIG. 23 is a flowchat showing the operation of a total yarns completion termination circuit.

In the circuit in which the up signal of the total yarns counter is on/off, if this counter is reset at the count value "0" (multi-winding display is "0"), the up signal of the total yarns counter will be on, and will be off by the photocell C (**67*c***) to proceed the total yarns counter.

d: Total Yarns completion Termination Circuit (FIG. 23)

Figure 25:
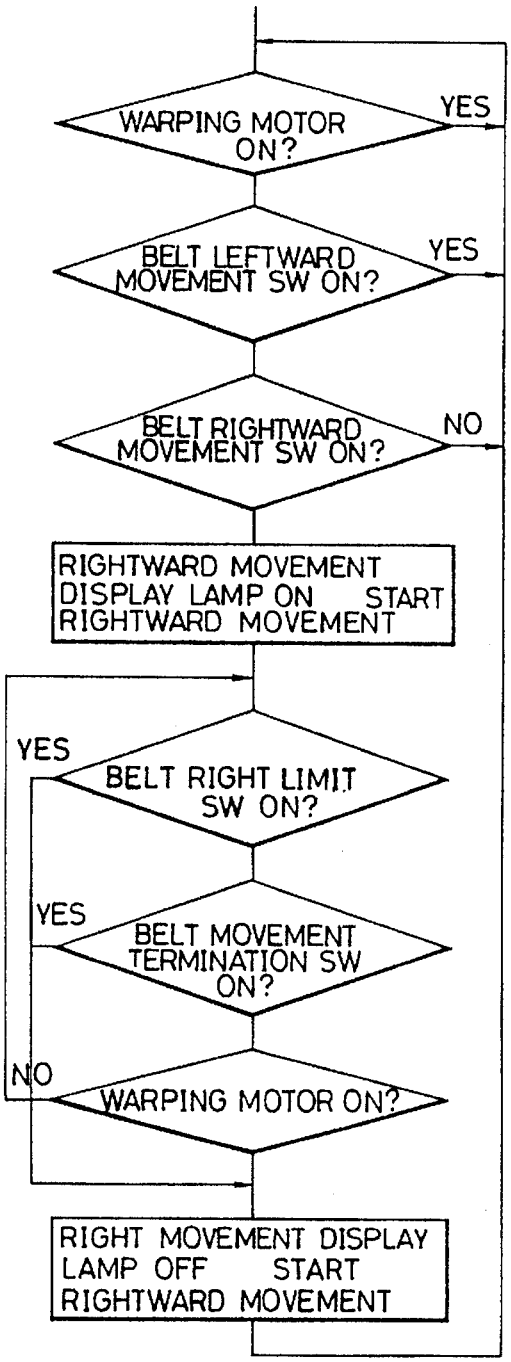
FIG. 25 is a flowchart showing the operation of a conveyor belt rightward moving circuit.

When the counted results of the total yarns counter reaches a preset value, the total yarns completion display lamp is turned on. Since this on signal of the total yarns completion display lamp is combined circuitwise with the warper termination switch, the warper is terminated. Releasing is performed by the reset switch of the total yarns counter.

e: Conveyor Belt Leftward Moving Circuit (FIG. 24) and f: Conveyor Belt Rightward Moving Circuit (FIG. 25)

Figure 26:
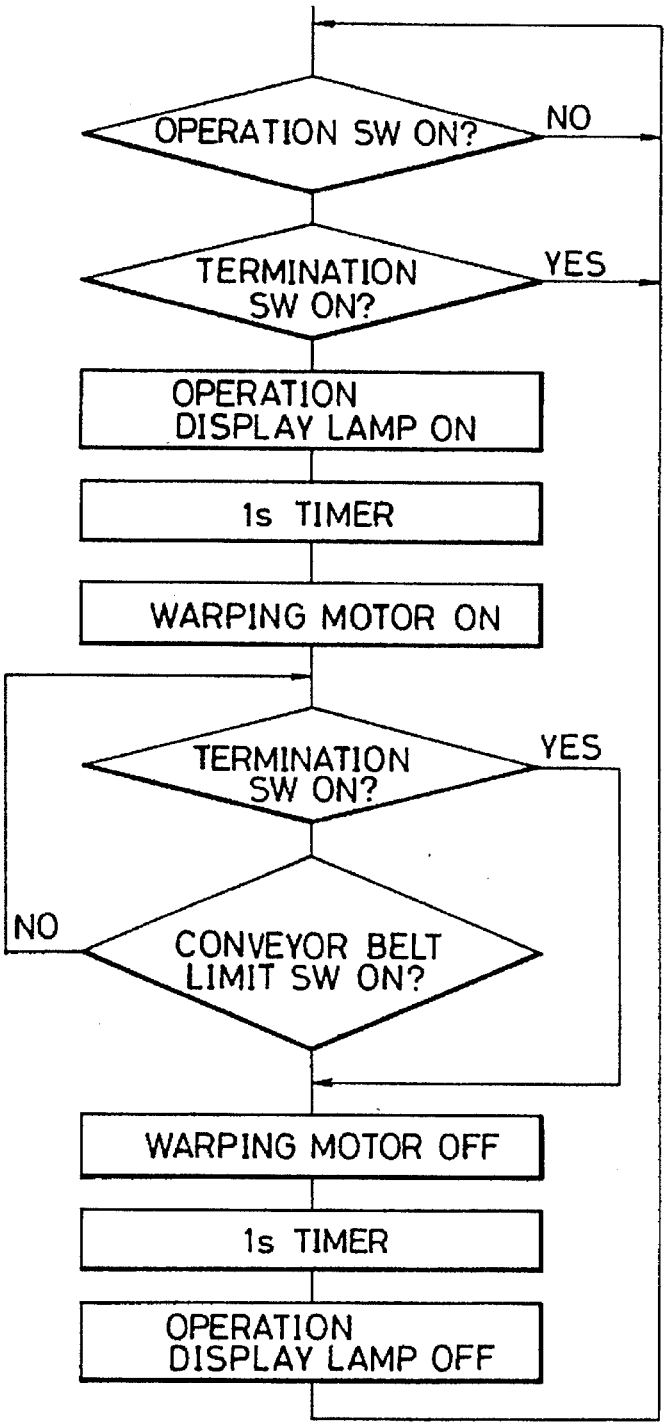
FIG. 26 is a flowchart showing the operation of an operation/terminating circuit.

Since the conveyor belt of the sample warper of this invention is not endless and is movable leftwardly and rightwardly, the conveyor belt can be moved independently by the leftward moving switch and the rightward moving switch to be located with the start position and with the rewinding position. For safety, a belt right limit switch and a belt left limit switch are located at the right and left limits, respectively. When the left limit switch is actuated during the leftward movement of the conveyor belt 17, the conveyor belt 17 is stopped. Likewise, when the right limit switch is actuated during the rightward movement of the conveyor belt 17, the conveyor belt 17 is stopped.

g: Operation/Termination Circuit (FIG. 26)

Figures 27A, 27B:
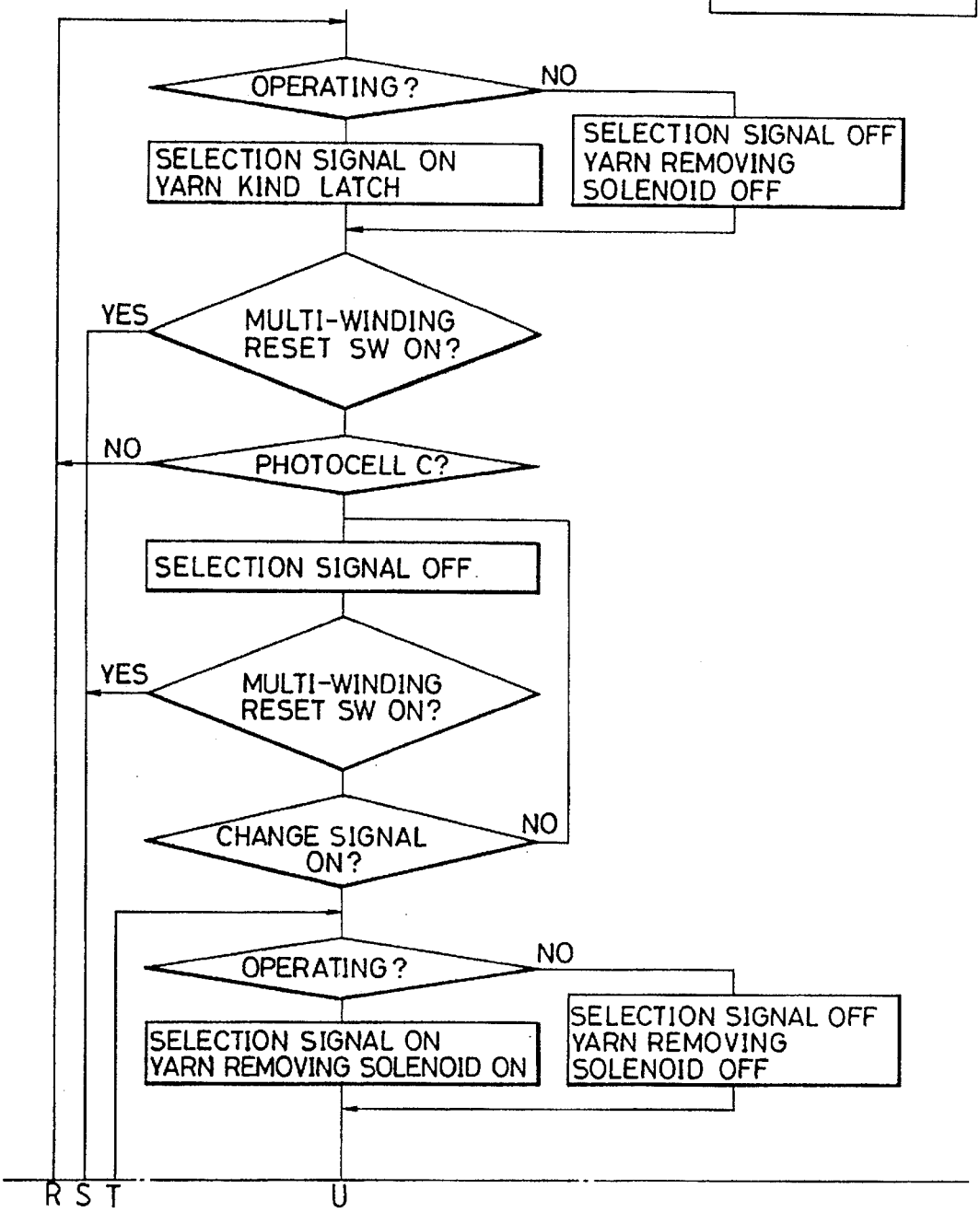
FIGS. 27(*a*) and 27(*b*) are a combined a flowchart showing the operation of a yarn selection circuit.
Figure 27B:
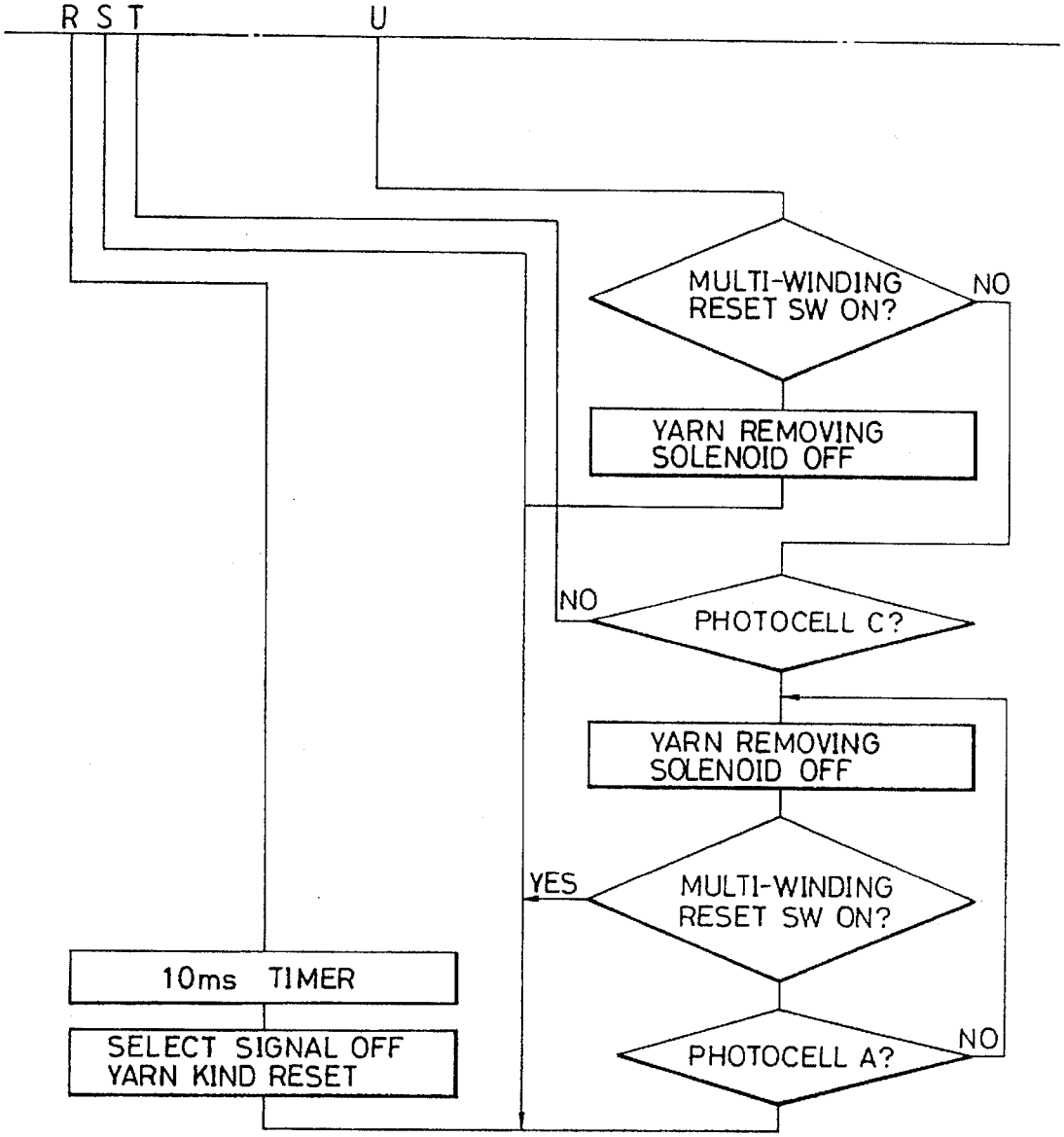

This circuit transmits rotation of the main motor 46 to the yarn introduction lever 6. After both the operation switch and termination switch are switched on, a one-second time is inserted to take a synchronism with a part of the program which part discriminates whether it is operating when it is either operated or terminated.

h: Yarn Selection Circuit (FIG. 27)

Figure 28:
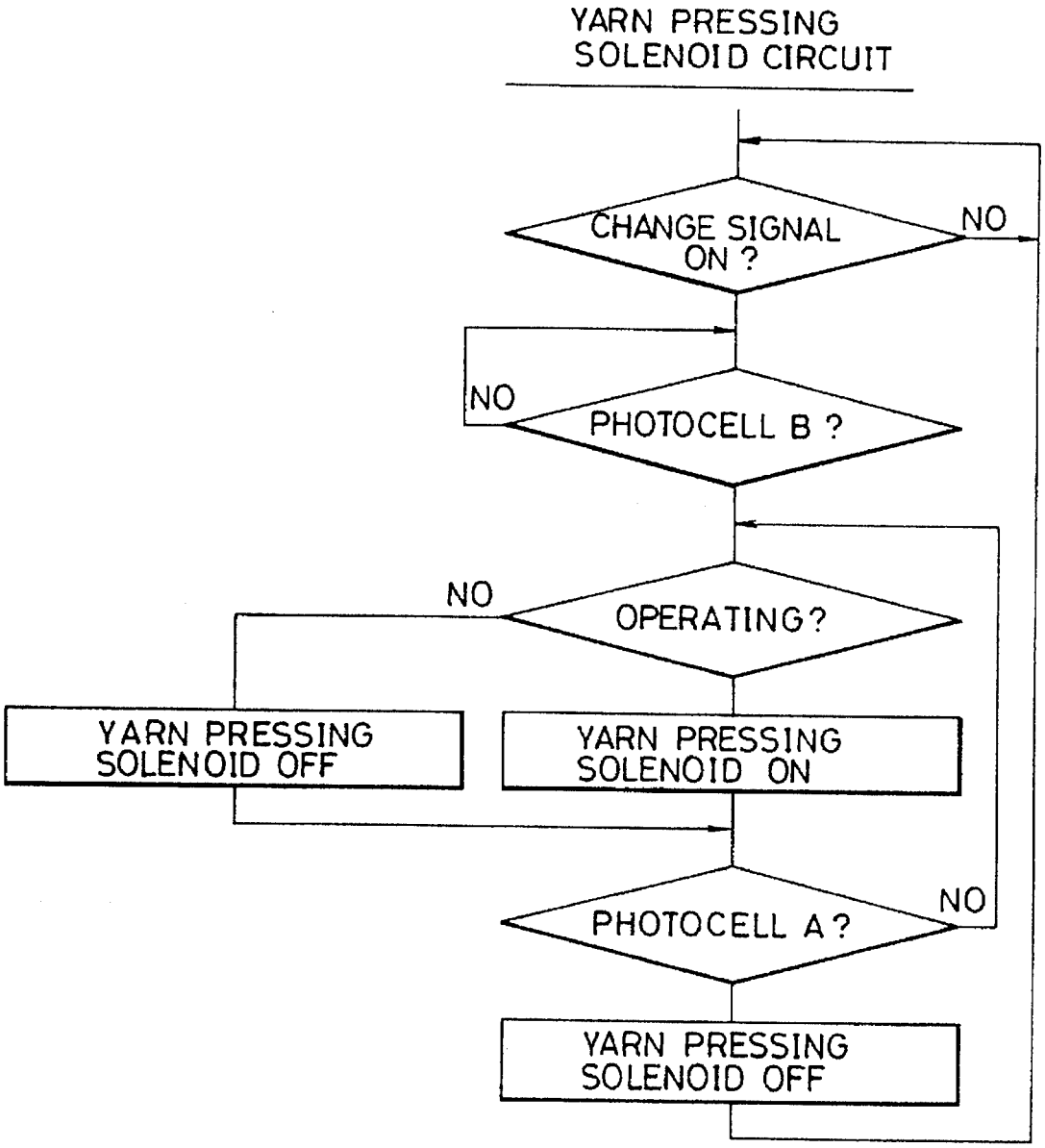
FIG. 28 is a flowchart showing the operation of a yarn pressing solenoid circuit.

This circuit controls the yarn selection and the yarn removing solenoids.

i: Yarn Pressing Solenoid Circuit (FIG. 28)

Figure 29:
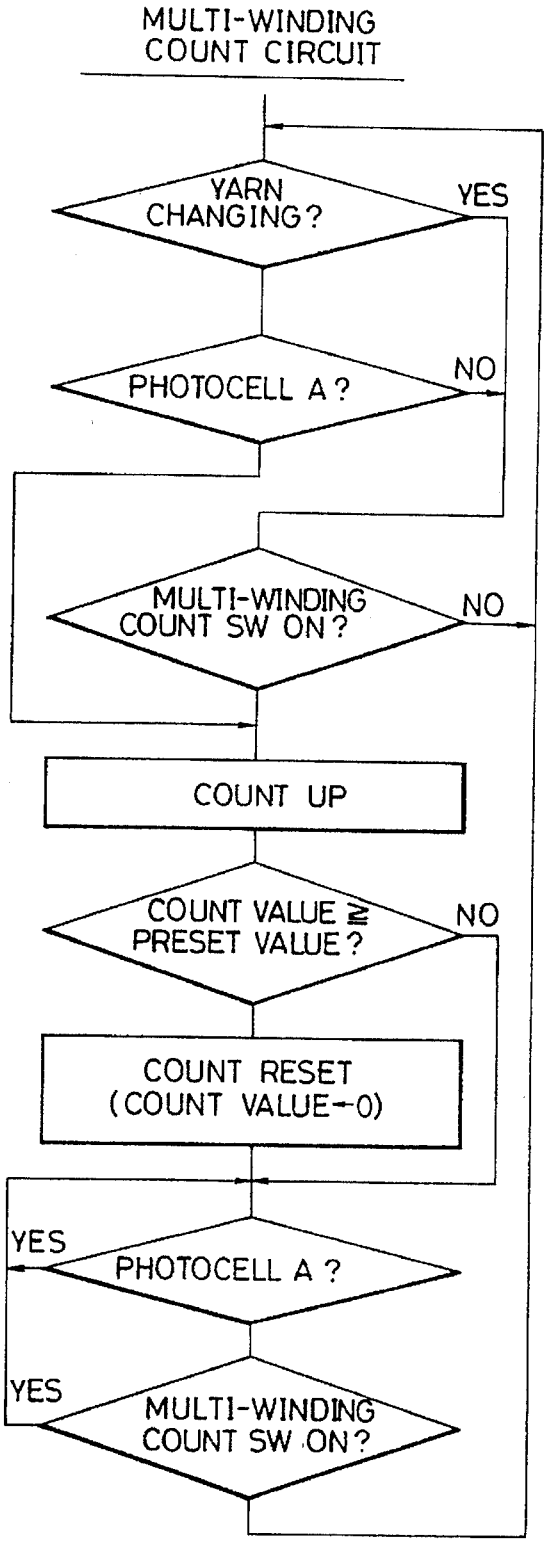
FIG. 29 is a flowchart showing the operation of a multi-winding count circuit.

This circuit is operable to render the yarn pressing solenoid operative/inoperative. After the change signal for yarn selection is on, the yarn pressing solenoid will be rendered operative only from the photocell B (67*b*) to the photocell A (67*a*).

j: Multi-Winding Count Circuit (FIG. 29)

Figure 30:
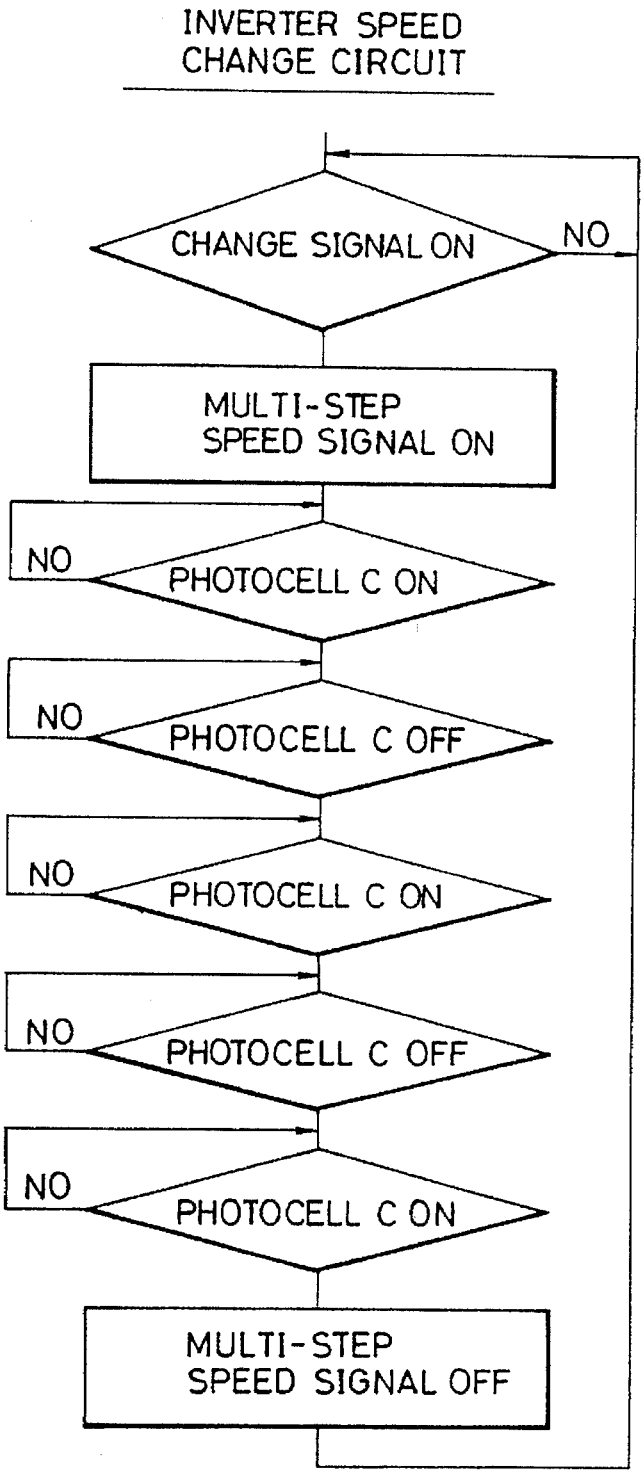
FIG. 30 is a flowchart showing the operation of an inverter speed change circuit.

This circuit counts the number of yarn windings on the warper drum A and displays the count value. The multi-winding count display takes one up by the output of the photocell A outside the duration of the yarn selection. As the count value becomes over a preset value of windings, the multi-winding display will be "0".

k: Inverter Speed Change Circuit (FIG. 30)

Figure 31:
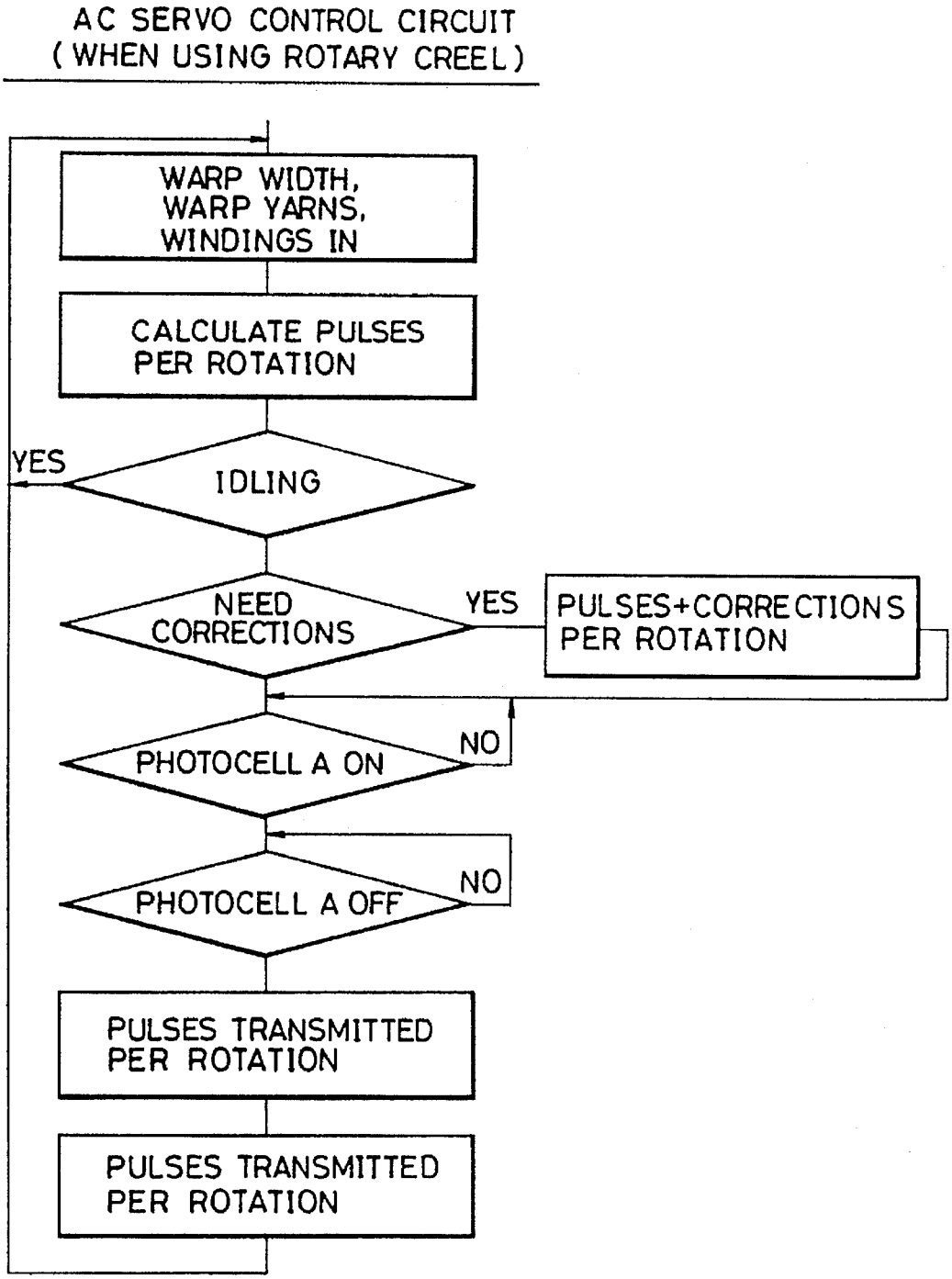
FIG. 31 is a flowchart showing the operation of an AC servo control circuit.

Here, the "inverter" drives the main motor 46 in the sample warper W and is not an inverter attached to the rotary creel. This circuit discriminates whether the change signal outputted from the program setting unit 78 in synchronism with the photocell A (67*a*) during the yarn changing is on and renders a multi-step speed change signal (low speed signal) to be on to rotate the main motor 46 at a low speed. then, confirming on/off signal of the photocell C (67*c*), the circuit sets the number of idling rotations, during which time the multi-step speed change signal (low speed signal) continues to be on. When it is released out of the idling rotation, the circuit renders the multi-step speed change signal to be off to rotate the main motor 46 at a high speed. The flowchart shows the example in which two idling rotations are made.

l: AC Servo Control Circuit (FIG. 31)

Figure 32:
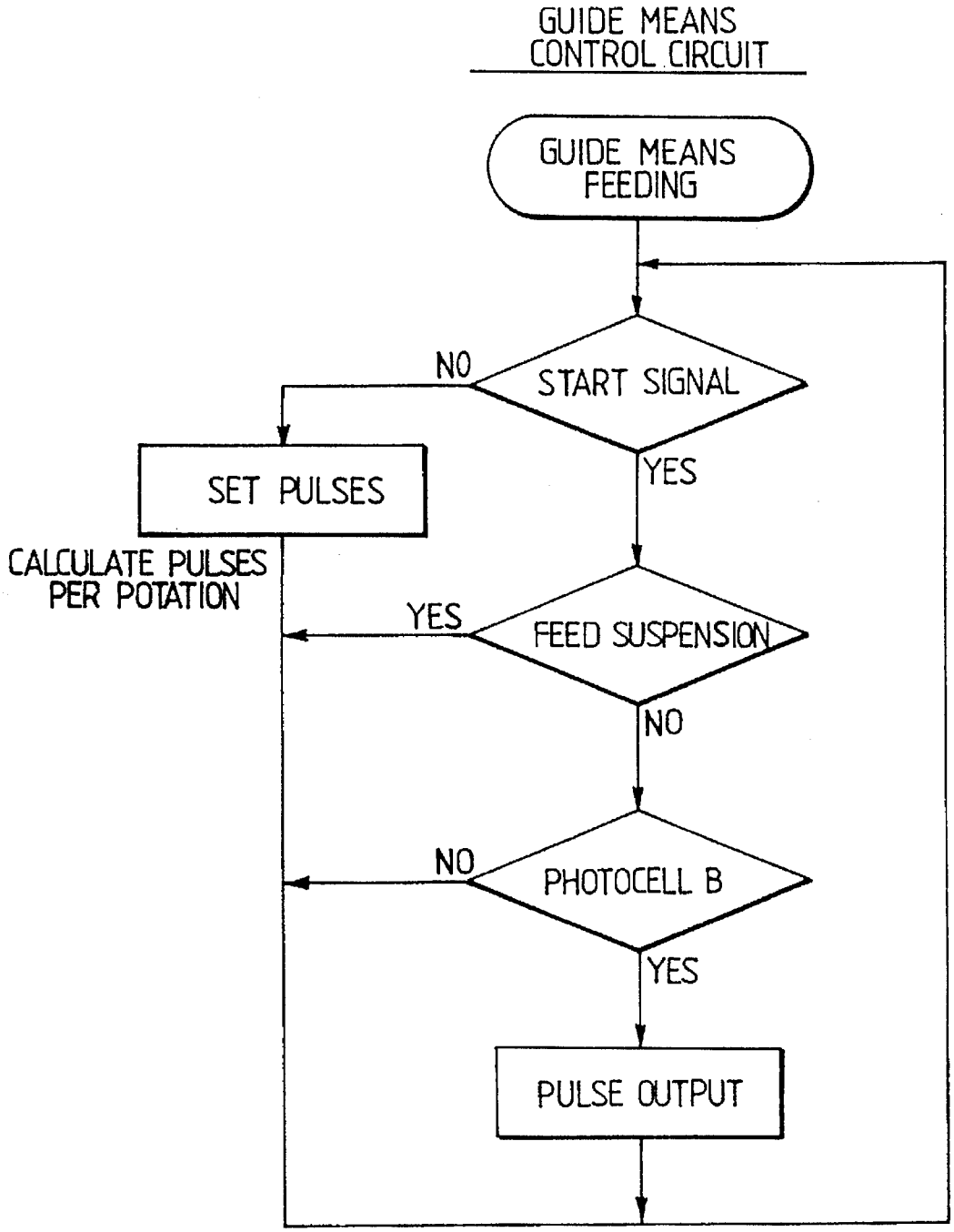
FIG. 32 is a flowchart showing the operation of a guide means control circuit.

This circuit reads the warping width, the number of warp yarns and the number of yarn windings from the warping length setting unit 90 and the number-of-windings setting unit RS1 and calculates the number of feed pulses per winding (provided that the AC servo motor is driven by the input of the number of pulses). The circuit also calculates a corrected number if correction is necessary. Then a discrimination is made on whether it is in idling rotation or not. If it is in idling rotation, the control routine returns to the start and does not advance. If it is not in idling rotation, the circuit discriminates the on/off signal of the photocell A (67*a*) and issues the calculated number of pulses to rotate the conveyor belt motor 51 to turn through an angle corresponding to the calculated number of pulses. The foregoing procedures are repeated.

m: Guide Means Control Circuit (FIG. 32)

In the circuit, the amount of feed or movement (e.g., 0.5 mm) of the guide means G per one revolution of the warper drum A by means of a digital switch DS (FIG. 17) is set, and the number of feed pulses equivalent to the amount of feed (e.g., 0.5 mm) per one revolution of the servo motor 164 at reduced speed are calculated and the calculated number of feed pulses are issued. Based on the issued pulses, the servo motor 164 is driven via a servo motor amplifier (motor drive). Operation of the servo motor 164 is translated via the drive systems M1, M2, N1, N2 into the amount of feed of the guide means G so that the feed/return of the guide means G is controlled by on/off operation of the electromagnetic clutches 126 at timing determined by respective signals from the photocell A (67*a*), the photocell B (67*b*) and the photocell C (67*c*). As described above, when the electromagnetic clutch 126 is on, the pitch feed of the guide means G is performed. Conversely, when the electromagnetic clutch 126 is off, the guide means G is quickly backed or returned to its original start position by the force of the spring 148. The foregoing procedures are repeated.

Figure 33:
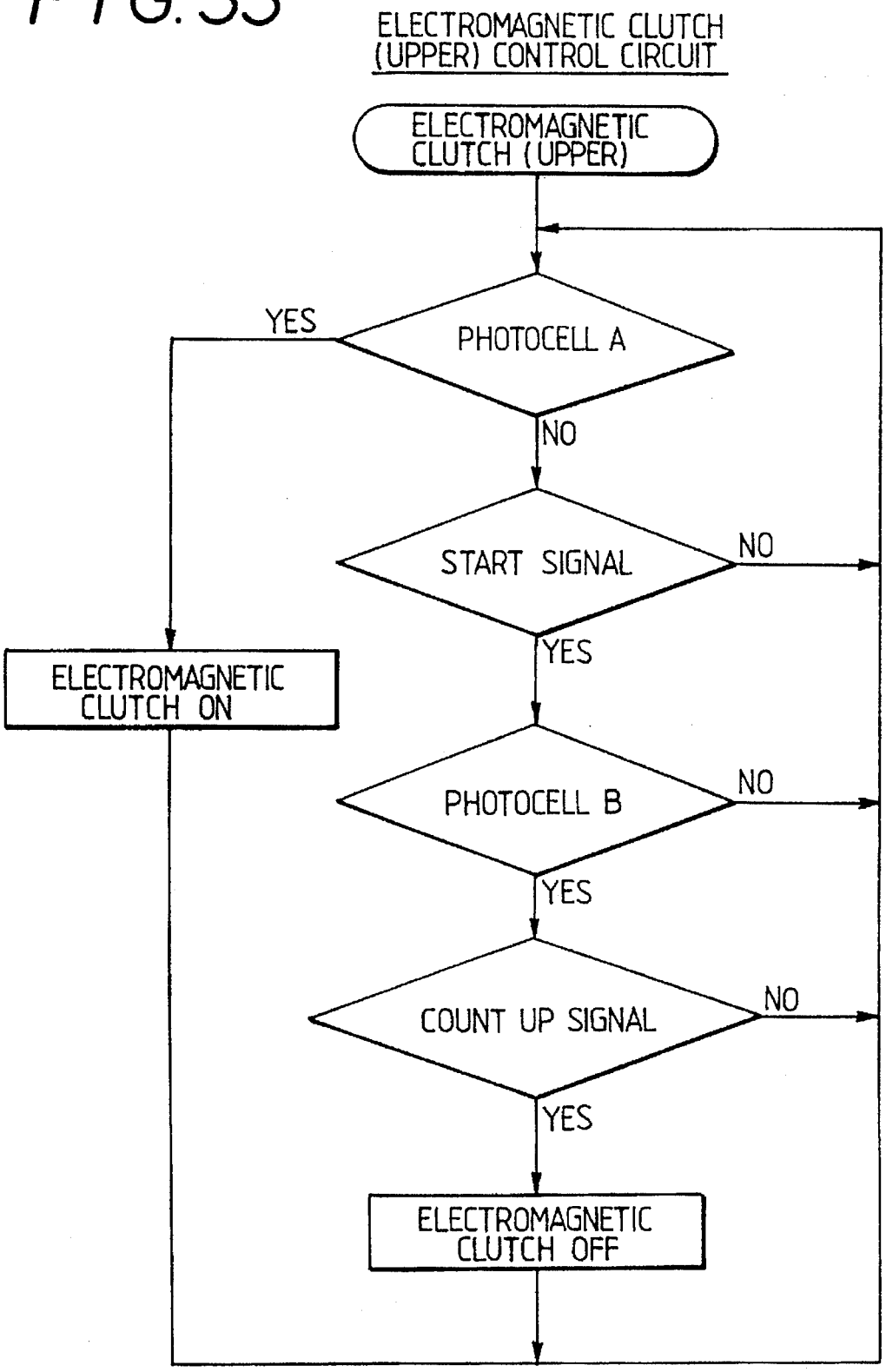
FIG. 33 is a flowchart showing the operation of an electromagnetic clutch control circuit for an upper drive system.

The amount of feed of the guide means G is set in a predetermined value (e.g., 0.5 mm) per one revolution of the yarn guide lever 6, in view of a preset multi-winding value (In general, this feed amount may be, for enough, in the range of from 0.1 to 1.0 mm). For example, when the feed amount of the guide means G is 0.5 mm, if the number of multi-windings is set to 20, the guide means G is advanced in the warping direction by 9.5 mm, and upon issue of a count up signal, the advanced guide means G is quickly returned to its original start position. The feed of the guide means G is controlled such that when the yarn guide lever 6 starts rotating, it passes the photocell B each time of which the number of pulses equivalent to the preset feed amount are outputted. Even when the yarn guide lever 6 passes the photocell A, no pulse will be issued on conditions that the start signal is off (during fine angular movement) or there is a period of time between the change signal and the next photocell A signal.

n: Upper Electromagnetic Clutch Group Control Circuit (FIG. 33)

Figure 34:
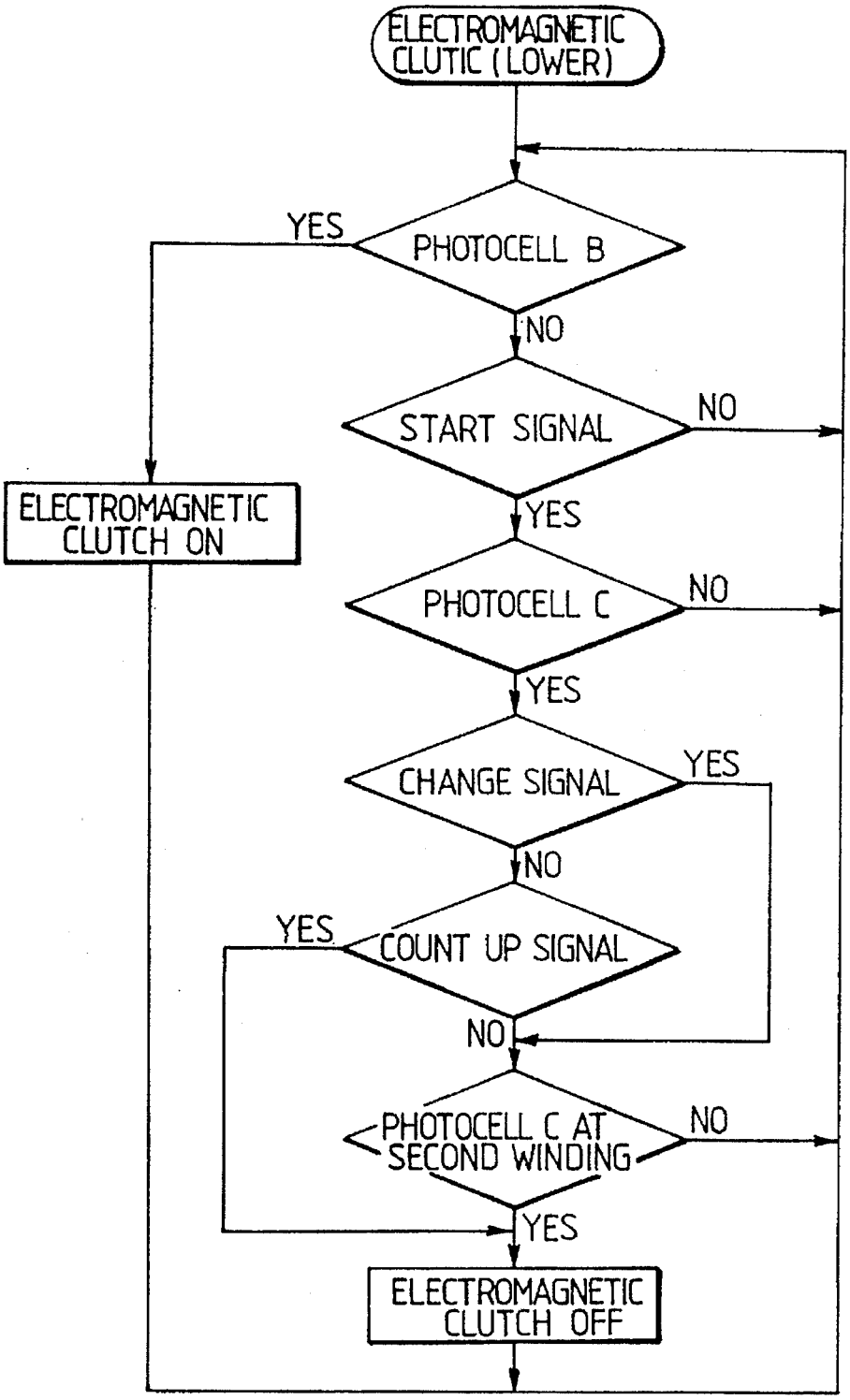
FIG. 34 is a flowchart showing the operation of an electromagnetic clutch control circuit for a lower drive system.

The eight electromagnetic clutches in the upper drive systems M1, M2 will be on in response to a signal from the photocell A. When the start signal is on, if the count up signal (count up for one yarn) is already on by the signal from the photocell B, the electromagnetic clutches of the upper drive systems M1, M2 will be off.

o: Lower Electromagnetic Clutch Group Control Circuit (FIG. 34)

The eight electromagnetic clutches in the lower drive systems N1, N2 will be on in response to a signal from the photocell B. When the start signal is on, if the count up signal (count up for one yarn) is already on by the signal from the photocell C (when the change signal is off), the electromagnetic clutches of the upper drive systems N1, N2 will be off. When the change signal is already on, the electromagnetic clutches in the lower drive systems N1, N2 will be off in response to a second signal from the photocell C, namely, a signal from the photocell C at the second winding.

Description will now be made on a practical example in which winding of alternately two red yarns and two white yarns are repeated up to the total number of 3,600 and the warping width of 100 cm with the warping length (number of multi-windings) of 10.

Firstly, the red yarn and the white yarn are set on the creel stand B and are threaded through the guide plate 24, the tension regulator 25, and the dropper ring 26. The red yarn is threaded through No. 0 guide of the yarn selection guide 27, and the white yarn is threaded through the No. 1 yarn selection guide 27. Then the red and while yarns are pressed against the base Y by the yarn fastener E with the permanent magnet.

Secondly, a program is prepared according to the yarn setting of the yarn selection guide 27. The display of the programmed contents is as follows:

| Address | Yarn kind | Number of Yarns | Number of Repeats |
|---|---|---|---|
| 000 | 0 | 002 | 000 |
| 001 | 1 | 002 | 000 |

At the same time, the number of multi-windings (i.e., 10) and the amount of movement of the conveyor belt (i.e., 100 cm when the total number of yarns reaches 3,600) are set. 3,600 is set in the total yarns counter.

As the yarn introduction lever 6 is angularly moved when the operation switch is switched on, the slitted plate 28 also is angularly moved in the same rotational speed, and at the same time, the conveyor belt 17 is moved a preset distance at a time from the front side to the rear side.

Then as the warper motor (main motor) 46 is rotated to locate the yarn introduction lever 6 at the start position between the photocell A (67*a*) and the photocell B (67*b*) and as the operation switch is switched on, the solenoid of the No. 0 yarn selection guide 27 is energized, and at the same time, the shedding up solenoid and the cut shedding up and down solenoids are energized, and one second after, the yarn introduction lever is angularly moved. At that time, the yarn introduction lever 6 catches the yarn of the No. 0 yarn selection guide 27, i.e., the red yarn and then turns to start winding the red yarn around the warper drum A.

Then a cut shed of the red yarn is formed by the action of the cut shedding up solenoid and the cut shedding down solenoid. As the yarn passes the photocell C (67*c*), the individual solenoid is de-energized. Partly since the cut shedding bar is located between the photocell B (67*b*) and the photocell C (67*c*), and partly since the shedding bar is located between the photocell A (67*a*) and the photocell B (67*b*), only the cut shed is formed of the red yarn at the start. When the yarn introduction lever 6 passes the photocell A (67*a*) for the first winding, the multi-winding display will be "1". When it passes the photocell A for the second winding, the multi-winding display will be "2". Similarly, when the yarn introduction lever 6 passes the photocell A for the ninth winding, the multi-winding display will be "9". When it passes the photocell A for the tenth winding, the multi-winding display will be "0".

Concurrently, the shedding up solenoid and the cut shedding up and down solenoids are energized, an the individual solenoid is de-energized as it passes the next photocell C so that a shed and a cut shed are formed. Concurrently with this, a total yarns count up signal is issued so that the total yarns counter displays "1".

When the yarn introduction lever 6 passes the photocell A for the eleventh winding, the multi-winding display will be "1". In the same manner as described above, the multi-winding display takes one up for each succeeding rotation of the yarn introduction lever 6. That is, when the yarn introduction lever 6 passes the photocell A for the nineteenth winding, the multi-winding display will be and when it passes the photocell A for the twentieth winding, the multi-winding display will be "0". At the same time, as the No. 0 yarn selection solenoid, the yarn removing solenoid, the shedding down solenoid, and the cut shedding up and down solenoids are energized, the red yarn is removed from the yarn introduction lever 6 and hence is received in the No. 0 yarn selection guide by the weight of the dropper ring 26.

At that time, when the yarn introduction lever 6 passes the photocell B, the yarn pressing solenoid will be energized to press the red yarn on the warper drum A so that any yarn slack will not come into the color on the warper drum A. As the yarn introduction lever 6 passes the next photocell C, the yarn removing solenoid will be de-energized. Concurrently, the total yarns counter displays "2" as the total yarns count up signal is issued. If the yarn introduction lever 6 passes the photocell A (67*a*) for the twenty-first winding, the No. 0 yarn selection solenoid will be de-energized, and the No. 1 yarn selection solenoid will be energized (At this time, the multi-winding count does not count). The yarn introduction lever 6 catches the while yarn of the No. 1 yarn selection solenoid to wind the while yarn around the warper drum A. The yarn pressing solenoid also is de-energized.

When the yarn introduction lever 6 passes the next photocell C (67*c*), the No. 1 yarn selection solenoid, the shedding down solenoid, the cut shedding up solenoid and the cut shedding down solenoid will be de-energized. In the same manner as described above, the multi-winding display takes one up for each of the succeeding rotation of the yarn introduction lever 6. When the yarn introduction lever 6 passes the photocell A (67*a*) for the twenty-ninth winding, the multi-winding display will be "9". And it passes the photocell A for the thirtieth winding, the multi-winding display will be "0". At the same time, the shedding up solenoid, the cut shedding up solenoid and the cut shedding down solenoid are energized. As the yarn introduction lever 6 passes the next photocell C (67*c*), individual solenoid will be de-energized to form a shed and a cut shed. Simultaneously with this, the total yarns count up signal is issued so that total yarns counter displays "3".

When the yarn introduction lever 6 passes the photocell A (67*a*) for the thirty-first winding, the multi-winding display will be "1". The count on the display increases by one for each of the subsequent rotation of the yarn introduction lever 6 as in the same manner as described above. As the yarn introduction lever 6 passes the photocell A (67*a*) for the fortieth winding, the multi-winding display will be "0". At the same time, the No. 1 yarn selection solenoid, the yarn removing solenoid, the shedding down solenoid, the cut shedding up solenoid and the cut shedding down solenoid are energized to remove the white yarn from the yarn introduction lever 6 so that the while yarn is received in the No. 1 yarn selection guide by the weight of the dropper ring 26. At that time, when the yarn introduction lever 6 passes the photocell B (67*b*), the yarn pressing solenoid is energized to press the yarn on the warper drum A. As it passes the next photocell C (67*c*), the yarn removing solenoid will be de-energized, whereupon the total yarns count up signal will be issued to render the total yarns counter to display "4".

Subsequently, when the yarn introduction lever 6 passes the photocell A (67*a*) for the forty-first winding, the No. 1 yarn selection solenoid will be de-energized, and the No. 0 yarn selection solenoid will be energized (at this time, the multi-winding count does not count). The yarn introduction lever 6 catches the red yarn to wind it around the warper drum A, whereupon the yarn pressing solenoid is de-energized. As it passes the next photocell C (67*c*), the No. 0 yarn selection solenoid, the shedding down solenoid, the cut shedding up solenoid and the cut shedding down solenoid will be de-energized.

Likewise, as long as any termination signal resulting from yarn breakage, double-yarn stopping, mischange, and right limit switch, and until the total yarns completion termination signal is inputted, the yarn introduction lever 6 is angularly moved, and the individual solenoid is energized/de-energized, so that the conveyor belt keeps feeding the yarn to perform the warping work.

Figures 35A, 35B, 35C, 35D, 35E, 35F, 35G, 35H, 35I, 35J, 35K, 35L, 35M, 35N, 35O, 35P:
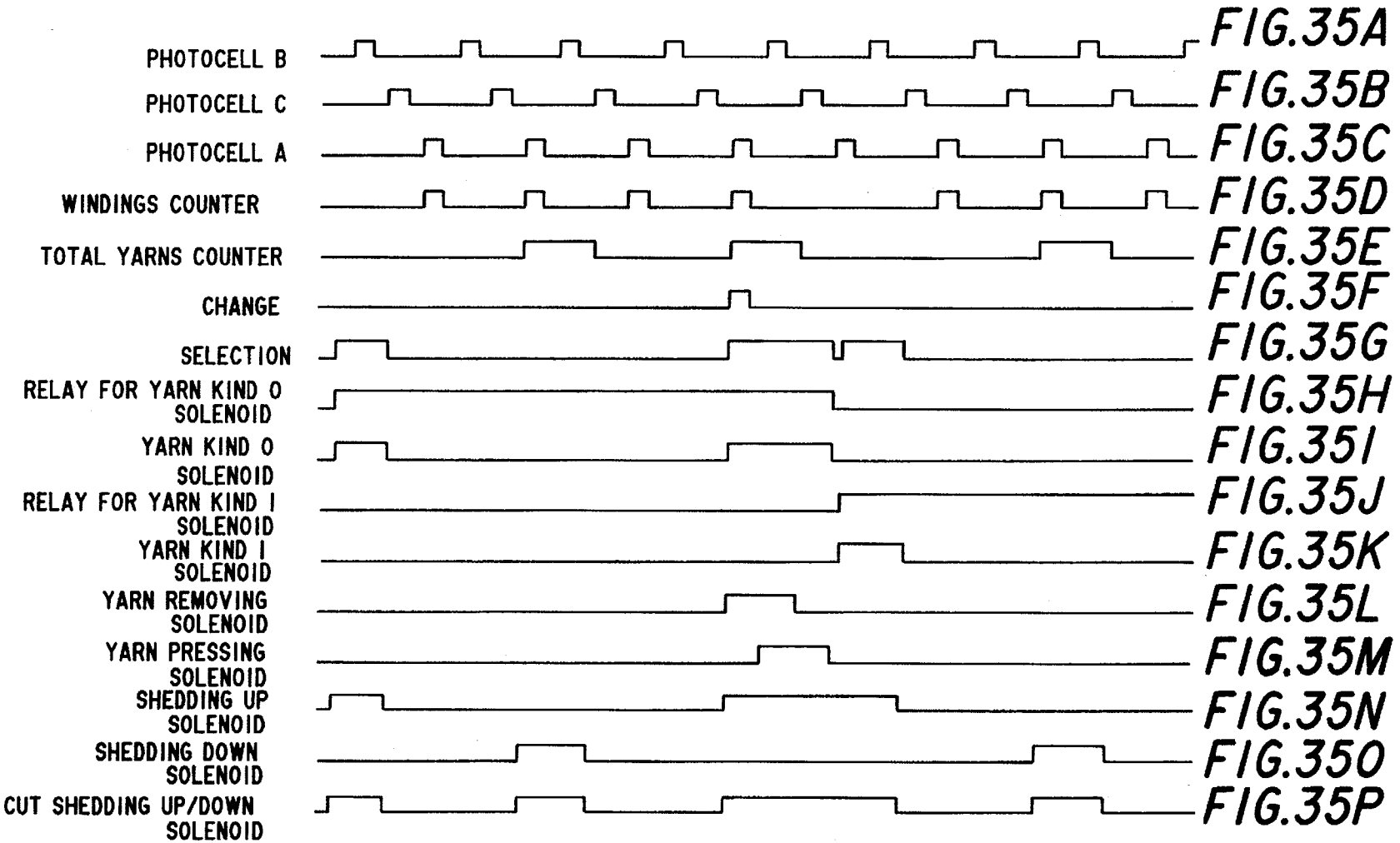
FIG. 35 is a time-chart showing the sequential operations of the warper.

FIG. 35 is a time-chart showing the operation of the electronically controlled sample warper of the present invention. According to this time-chart, a double winding of 0 kind yarn is wound twice, a double winding of 1 kind yarn is wound twice, whereupon these are repeated. Here "double winding" is a value preset in the range of from 0 to 19 by the multi-winding setting switch. The principle of operation shown in this time-chart is the same even when the preset multi-winding value is increased. The signals from these three photocell switches are called here "photocell A", "photocell B" and "photocell C". The operation starts between the photocell switch A and the photocell switch B, whereupon photocell B—photocell C—photocell A—photocell B—photocell C—photocell A are successively issued. Hereinafter these signals are utilized to take the following timing.

A count signal is issued each and every time the photocell A detect that the slit 28*a* of the slitted plate 28 passes. The count signal is not issued only at one time after a change signal received from the program setting unit, for the yarn introduction lever 6 is angularly moved without any load. A count up signal will be on between the photocell A and the photocell C every time it reaches a preset multi-winding value. The count up signal renders the total yarns counter up. Thus a count up signal is transmitted to the program setting unit.

A change (yarn exchange) signal is transmitted from the program setting unit in synchronism with the photocell A and is used in changing the yarn kind. A selection signal transmits a signal to one of 0-n kind yarn solenoids when a corresponding one of the relays for the 0-n kind yarn solenoids is on. This solenoid is on between the start time and the photocell C, whereupon a confirmation is made as to whether the change signal is received. The solenoid will be on between the photocell A and the next photocell A, will be off for a short time (10 to 50 ms), immediately thereafter will be on, and will be on until the next photocell C.

The relays for 0, 1 kind yarn solenoids are adjusted in timing by the controller based on the yarn kind setting signal transmitted from the program setting unit, and are kept energized until a selection signal for yarn changing is issued. The yarn removing solenoid signal is on between the photocell A and the photocell C after it is confirmed that a change signal has been received. The yarn pressing solenoid signal is on between the photocell B and the photocell A after the yarn removing solenoid signal has been on.

The shedding up solenoid signal and the shedding down solenoid signal may be started from either signal and will be on alternately. Between the start and the photocell C, either signal confirms that a count up signal is on not during the yarn changing and that a change signal is received. Then either signal will be on for a period of time from the photocell A and the next photocell C. Though there is no illustration in the time-chart of FIG. 35, if one of the shedding up and down solenoid signals is on, both the cut shedding up and down solenoid signals will be on.

Further, by varying the timing of the shedding up and down solenoid signals, it is possible to form sheds of different kinds which can be rewound directly on a weaving beam 49. The warper starts its operation by switching the start switch on and terminates its operation by switching the termination switch on. Alternatively, the warper may be terminated by the double-winding termination switch for checking the state of winding two or more yarns at one time as well as by the mischange signal to notify the state of not winding the yarn during the yarn changing, the total yarns counter to notify the completion of winding the total yarns, the yarn breakage detection signal to notify the yarn breakage, etc.

Figures 36A, 36B, 36C, 36D, 36E:
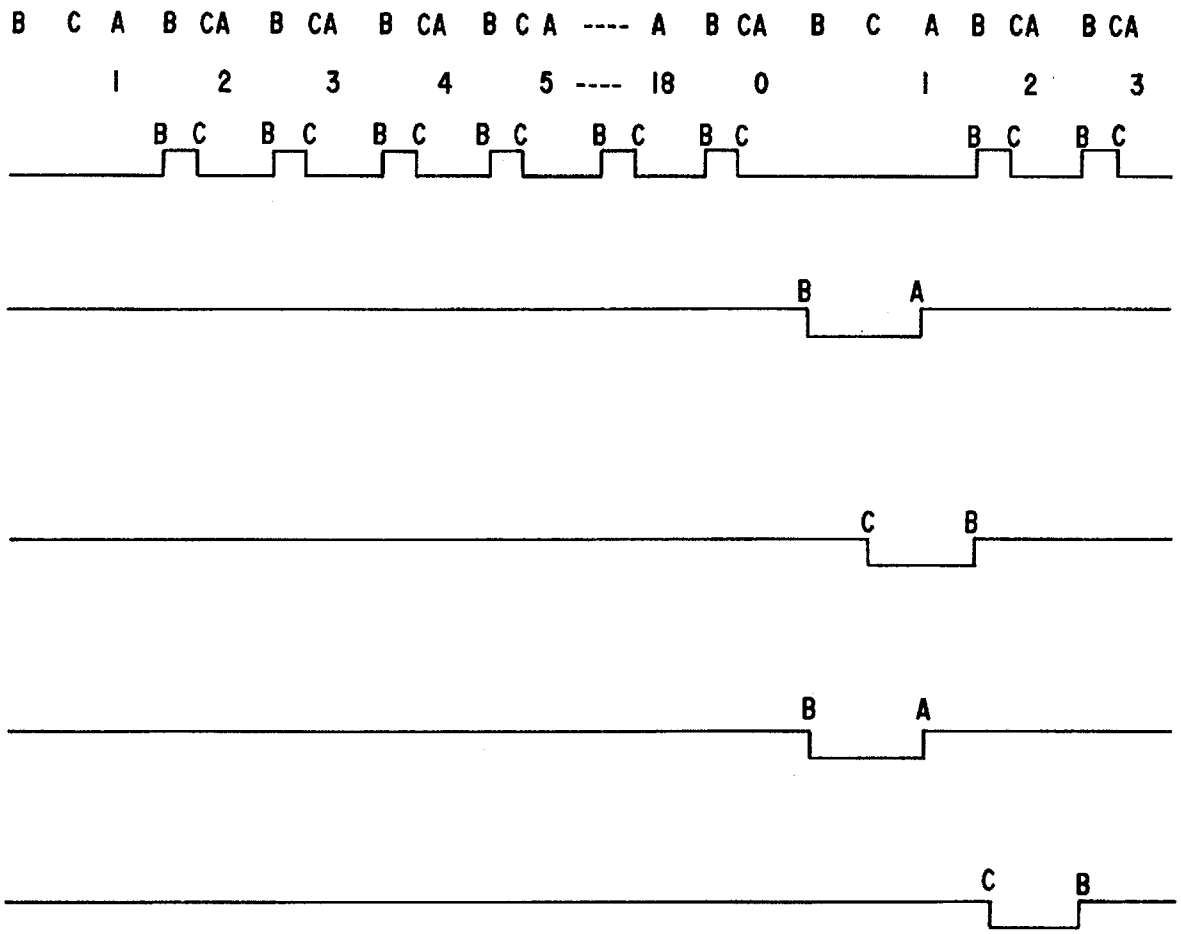
FIG. 36 is a time-chart showing the sequential operations of the guide means.

FIG. 36 is a time-chart showing the operation which is peculiar to the electronically controlled sample warper capable of warping yarns, with windings of yarns neatly layered on the warper drum A in regular order.

The time-chart of FIG. 36 illustrates the example in which the yarn is wound nineteenth (nineteen windings) in the shedding up mode (the shedding of the yarn to be wound on the warper drum A starts with the shedding up). The yarn to be wound on the warper drum A is engaged on the yarn introduction part 6' aligned with the slit 28*a* of the slitted plate 28, and this yarn introduction part 6' starts from between the photocell A and the photocell B.

The start switch is switched on whereupon the yarn introduction lever 6 is angularly moved. At the same time, the electromagnetic clutches of all of the guide means G are on, so that all the guide means G are placed in a condition in which the pitch feed can be performed upon operation of the servo motor 164. The multi-winding count signal is issued each and every time the photocell A detects that the slit 28*a* passes. The total yarns count up signal will be on between the photocell A and the photocell C every time it reaches a preset multi-winding value (nineteen in the example of FIG. 36). As described above, the count up signal renders the total yarns counter up (in the time-chart shown in FIG. 36, the total yarns counter display is omitted).

As the yarn introduction lever 6 moves between the photocell B and the photocell C for the second winding, the servo motor will be on so that the pitch feed of the guide means G is performed. Similarly, from the third winding up to the nineteenth winding, between the photocell B and the photocell C, the pitch feed of the guide means G is performed. When the yarn introduction lever 6 passes the photocell A for the nineteenth winding, the multi-winding display will be "0" and the total yarns counter will take one count up. With this count up signal, the conveyor belt 17 is moved in the warping direction by a distance equal to the longitudinal warp density, described later.

In the case where the yarn changing is not executed, the photocell B at the first winding of the yarn introduction lever 6 subsequent to the count up signal and the photocell A at the second winding of the same, the upper electromagnetic clutch group will be off, so that the guide means G associated with the upper electromagnetic clutch group are returned to their original position by the forces of the springs 148. On the other hand, between the photocell C at the first winding of the yarn introduction lever 6 subsequent to the count up signal and the photocell B at the second winding of the same, the lower electromagnetic clutches will be off with the result that the guide means G associated with the lower electromagnetic clutch group are returned to their original position by the forces of the springs 148. The on/off timing of the lower electromagnetic clutch group is delayed from the on/off timing of the upper electromagnetic clutch group because the on/off operation must be done after the yarn passes the bottom of the warper drum A.

When the yarn changing is executed, the on/off operation of the upper clutch group is achieved in the same manner as done in the operation without yarn changing. However, so far as the lower electromagnetic clutch group is concerned, this clutch group will be off between the photocell C at the second winding of the yarn introduction lever 6 subsequent to the count up signal and the photocell B at the third winding of the same. Thus, the guide means G associated with the lower electromagnetic clutch group are returned to their original position by the forces of the springs 148. This on/off timing of the lower electromagnetic clutch group is peculiar to the yarn changing operation.

Subsequent to the count up signal, as the yarn introduction lever 6 moves between the photocell B and the photocell C for the second winding, the servo motor 164 will be on so that the pitch feed of the guide means G is performed. Similarly, from the third winding to the nineteenth winding, between the photocell B and the photocell C the pitch feed of the guide means G is achieved. When the yarn introduction lever 6 passes the photocell A for the nineteenth winding, the multi-winding display will be "0" and the total yarns counter takes one count up. With this count up signal, the conveyor belt 17 is moved in the warping direction by a distance equal to the longitudinal warp density, described later. The foregoing procedures are repeated to achieve an orderly winding of warp yarns.

Figure 37:
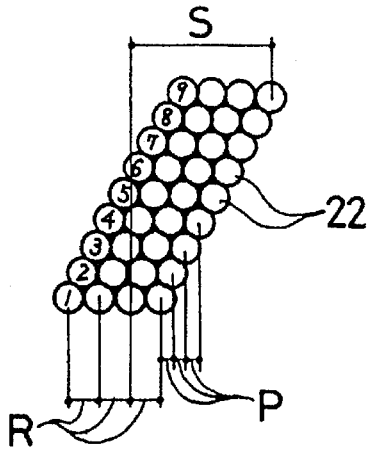
FIG. 37 is a diagrammatical view showing an example of windings of yarn neatly layered in regular order according to the invention.
Figure 38:
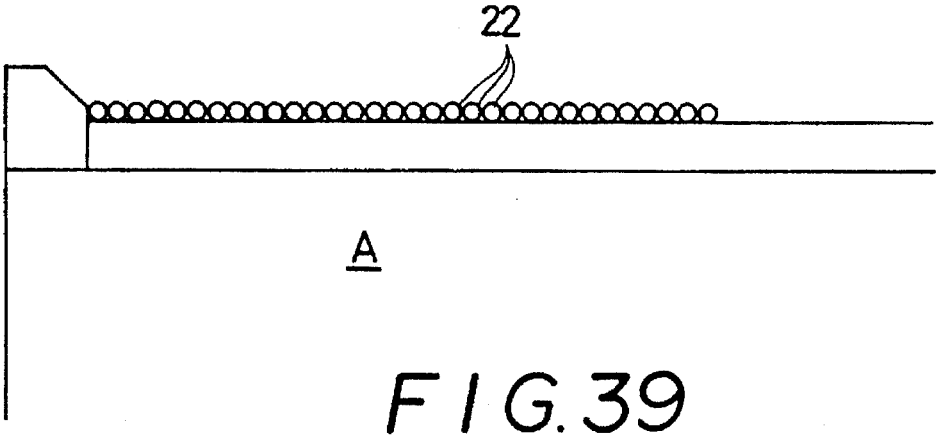
FIG. 38 is a diagrammatical view showing a winding condition of a conventional warper in which the warping length is relatively small.
Figure 39:
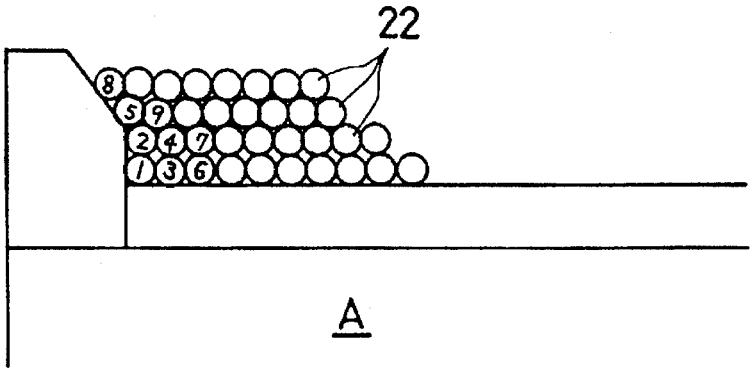
FIG. 39 PRIOR ART
FIG. 39 is a diagrammatical view showing a winding condition of the conventional warper in which the warping length is relatively large.

In the embodiment described above, the guide means G for guiding a yarn from the yarn introduction lever 6 is slidably mounted on the drum spoke 16 at an end adjacent to the yarn introduction lever 6 and slidably movable in the longitudinal direction of the drum spoke 16. For each revolution of the yarn introduction lever 6, the guide means G is moved in the warping direction by a distance P which is twice to half the thickness or diameter of the yarn 22. When the number of revolutions of the yarn introduction lever 6 reaches a preset multi-winding value, the guide means G is rapidly moved back by a distance Q which is equal to the product of the distance P and the preset multi-winding value, thus returning to its original start position. Concurrently therewith, the conveyor belts 17 are moved in the warping direction by a distance R which is equal to the longitudinal warp density, namely, the warping width divided by the total number of yarns (number of warp yarns). Thus, the yarn 22 can be wound on the warp drum A with windings of yarn neatly layered one on another in regular order (see FIG. 37).

The distance P of the pitch feed of the guide means G is preferably in the range of from 2 to 0.5 times the thickness of the yarn 22. The distance P may be outside the range specified above so long as orderly winding of the invention is possible.

The orderly winding may be practiced by any other suitable means. For example, the yarn introduction lever 6 is rendered movable in the warping direction such that for each revolution of the yarn introduction lever 6, the yarn introduction lever 6 is moved in the warping direction by a distance P which is two times to half the thickness of the yarn. When the number of revolutions of the yarn introduction lever 6 reaches a preset multi-winding value, the yarn introduction lever 6 is quickly moved back by a distance Q (distance P x preset multi-winding value), thus returning to its original start position. Concurrently therewith, the conveyor belts 17 are moved in the warping direction by a distance R which is equal to the longitudinal warp density, namely, the warping width divided by the total number of yarns (number of warp yarns).

As still another alternative, said conveyor belts 17 may be rendered movable such that for each revolution of the yarn introduction lever 6, the conveyor belts 17 are moved in a direction opposite to the warring direction by a distance P which is two times to half the thickness of the yarn 22, and when the number of revolutions of the yarn introduction lever 6 reaches a preset multi-winding value, the conveyor belts 17 are moved in the warping direction by a distance T which is the sum of the distance Q (distance P x preset multi-winding value) and a distance R equal to the longitudinal warp density, i.e., the warping width divided by the total number of yarns.

The warping method of the invention is achieved in such a manner that the yarn for the "n"th winding is wound on said warper drum A such that at the beginning of the "n"th winding, the yarn is placed ahead of an end of a winding of yarn formed on said warper drum by the "n-1"th winding.

According to the orderly winding warping method of the present invention, the yarn wound at the beginning of a particular winding is located ahead of the yarn wound in the preceding winding.

In the foregoing description, the yarn kinds are 0-n, an n usually stands for a digit up to 9 but may be more than 9. In the above description, the number of windings is 1–19 but should by no means be limited to these specific figures. The relay part, i.e., the driver part of the solenoid may be a semiconductor such as a transistor or a thyristor. The switch of each of the photocells A, B, C may be a magnet-sensitive element, a mechanical limit switch or the like. The controller is preferably composed of a microcomputer, a memory, a TTL, a CMOS, a photocoupler and the like, but it may be an ordinary sequence controller.

As described above according to the invention, since the yarn wound at the beginning of a particular winding is located ahead of the yarn wound in the preceding winding, it is possible to warp yarns on a warper drum, with windings of the yarns neatly layered one above another in regular order, thus enabling the yarns to be readily rewound on beams on a weaving machine even when the warping length, i.e., the number of multi-windings is relatively large such as four or more windings.

Obviously, various minor changes and modifications of the present invention are possible in the light of the above teaching. It is therefore to be understood that within the scope of the appended claims the invention may be practiced otherwise than as specifically described.

What is claimed is:

1. An electronically controlled sample warper for automatically warping in a desired pattern of yarns, said warper including a warper drum having a longitudinal axis and longitudinally extending drum spokes, a yarn introduction lever rotatably disposed adjacent to one end of the warper drum, rollers rotatably mounted at opposite ends of each drum spoke, conveyor belts wound around said rollers, means for moving each of said conveyor belts a desired distance longitudinally of said drum and a yarn guide device; said yarn guide device comprising guide means slideably mounted on each of the drum spokes at said end adjacent to the yarn introduction lever, said guide means being slidable in the longitudinal direction of the drum spoke for guiding the yarn from the yarn introduction lever, means for moving said guide means to move the yarn in a warping direction by a first distance which is twice to half the thickness of the yarn for each revolution of the yarn introduction lever, means for rapidly moving said guide means back a second distance which is equal to the product of said first distance and a preset multi-winding value when the number of revolutions of the yarn introduction lever reaches said preset multi-winding value, thereby returning said guide means to an original start position, and means for moving said conveyor belts in the warping direction by a third distance which is equal to a longitudinal warp density, said moving of said conveyor belts being concurrently with a rapid movement back of said guide means through said second distance by said means for rapidly moving said guide means.

2. The sample warper as claimed in claim 1, wherein said means for moving said guide means to move the yarn in the warping direction comprises a slide base attached to the drum spoke, a slide unit slideably mounted on said slide base and carrying said guide means, a rack on said slide unit, a selectively engageable clutch mounted on the warper drum and having a clutch shaft and a clutch gear, said clutch gear being engaged with said rack, control means for controlling engagement and disengagement of said clutch, and drive means on the warper drum for driving said clutch shaft.

3. The sample warper as claimed in claim 2, further comprising a block member attached to said rack, a pin extending from said block in parallel with the longitudinal axis of the drum, a support member attached to said slide base and having a through-hole, said pin extending through said through-hole, and a compression spring mounted on said pin and interposed between said block and said support member to urge said rack in a direction opposite to the warping direction.

4. The sample warper as claimed in claim 3, wherein said warper further includes a hollow shaft upon which the warper drum is mounted; and wherein said drive means on the warper drum for driving said clutch shaft comprises a drive motor mounted on the hollow shaft, a drive gear driven by said motor, a center gear rotatably mounted on the hollow shaft and driven by said drive gear, and plural drive systems engaging said center gear; each drive system including a transmission gear rotatably mounted on the warper drum and engaged with said center gear, a worm gear mounted on each clutch shaft associated with the particular drive system, a worm engaging each worm gear, a sprocket wheel driving each worm, plural idler gears rotatably mounted on the warper drum between adjacent sprocket wheels, a main sprocket wheel driven by said transmission gear, and a sprocket chain trained around said main sprocket wheel, said sprocket wheels and said idler gears.

5. The sample warper as claimed in claim 1, wherein said guide means on each drum spoke further includes a U-shaped bracket; a pair of yarn guide bases, each one mounted on one arm of the U-shaped bracket, each yarn guide base having a guide ramp surface for guiding the yarn from the yarn introduction lever to a surface of an adjacent one of the conveyor belts, and a yarn guide recess positioned to guide the yarn along the surface of the adjacent one of the conveyor belts; and a slide unit on the drum spoke supporting said U-shaped bracket.

6. The sample warper as claimed in claim 5, wherein said means for moving said guide means to move the yarn in the warping direction comprises a slide base attached to the drum spoke, the slide unit being slideably mounted on said slide base and carrying said guide means, a rack on said slide unit, a selectively engageable clutch mounted on the warper drum and having a clutch shaft and a clutch gear, said clutch gear being engaged with said rack, control means for controlling engagement and disengagement of said clutch, and drive means on the warper drum for driving said clutch shaft.

7. The sample warper as claimed in claim 6, further comprising a block member attached to said rack, a pin extending from said block in parallel with the longitudinal axis of the drum, a support member attached to said slide base and having a through-hole, said pin extending through said through-hole, and a compression spring mounted on said pin and interposed between said block and said support member to urge said rack in a direction opposite to the warping direction.

8. The sample warper as claimed in claim 6, wherein said warper further includes a hollow shaft upon which the warper drum is mounted; and wherein said drive means on the warper drum for driving said clutch shaft comprises a drive motor mounted on the hollow shaft, a drive gear driven by said motor, a center gear rotatably mounted on the hollow shaft and driven by said drive gear, and plural drive systems engaging said center gear; each drive system including a transmission gear rotatably mounted on the warper drum and engaged with said center gear, a worm gear mounted on each clutch shaft associated with the particular drive system, a worm engaging each worm gear, a sprocket wheel driving each worm, plural idler gears rotatably mounted on the warper drum between adjacent sprocket wheels, a main sprocket wheel driven by said transmission gear, and a sprocket chain trained around said main sprocket wheel, said sprocket wheels and said idler gears.

9. A warping method carried out by an electronically controlled sample warper for automatically warping in a desired pattern of yarns, said warper including a warper drum having a longitudinal axis and longitudinally extending drum spokes, a yarn introduction lever rotatably disposed adjacent to one end of the warper drum, rollers rotatably mounted at opposite ends of each drum spoke, conveyor belts wound around said rollers, means for moving each of said conveyor belts a desired distance longitudinally of said drum and a yarn guide device; said yarn guide device comprising guide means slideably mounted on each of the drum spokes at said end adjacent to the yarn introduction lever, said guide means being slidable in the longitudinal direction of the drum spoke for guiding the yarn from the yarn introduction lever, said method comprising the steps of moving said guide means to move the yarn in a warping direction by a first distance which is twice to half the thickness of the yarn for each revolution of the yarn introduction lever, rapidly moving said guide means back a second distance which is equal to the product of said first distance and a preset multi-winding value when the number of revolutions of the yarn introduction lever reaches said preset multi-winding value, thereby returning said guide means to an original start position, moving said conveyor belts in the warping direction by a third distance which is equal to a longitudinal warp density concurrently with the rapid movement of said guide means through said second distance to the original start position, and winding a yarn for a "n-1" winding and a yarn for an "n"th winding on said warper drum such that at a beginning of the "n"th winding, the yarn is placed ahead of an end of a winding yarn formed on said warper drum by the "n-1" winding.

* * * * *